US012788204B2

(12) United States Patent
Kim et al.

(10) Patent No.: US 12,788,204 B2
(45) Date of Patent: Nov. 10, 2026

(54) DISHWASHER

(71) Applicant: LG ELECTRONICS INC., Seoul (KR)

(72) Inventors: Seung Hun Kim, Seoul (KR); Byeong Hyeon Ju, Seoul (KR); Chang Yoon Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 218 days.

(21) Appl. No.: 18/632,823

(22) Filed: Apr. 11, 2024

(65) Prior Publication Data

US 2024/0341560 A1 Oct. 17, 2024

(30) Foreign Application Priority Data

Apr. 17, 2023 (KR) ..... 10-2023-0050083
Sep. 18, 2023 (KR) ..... 10-2023-0124183

(51) Int. Cl.
*A47L 15/00* (2006.01)
*A47L 15/42* (2006.01)
*A47L 15/48* (2006.01)

(52) U.S. Cl.
CPC ..... *A47L 15/0018* (2013.01); *A47L 15/4285* (2013.01); *A47L 15/481* (2013.01); *A47L 15/485* (2013.01); *A47L 2501/06* (2013.01); *A47L 2501/11* (2013.01)

(58) Field of Classification Search
None
See application file for complete search history.

(56) References Cited

U.S. PATENT DOCUMENTS 7,998,280 B2 * 8/2011 Son ..... A47L 15/0049 134/57 D
9,055,858 B2 * 6/2015 Jerg ..... A47L 15/481

FOREIGN PATENT DOCUMENTS

EP 1830690 3/2015
EP 2352410 9/2015

* cited by examiner

*Primary Examiner* — Rita P Adhlakha
(74) *Attorney, Agent, or Firm* — Fish & Richardson P.C.

(57) ABSTRACT

A dishwasher includes a regeneration heater and a washing water heater that are controlled to operate simultaneously so that an operation period of the regeneration heater and an operation period of the washing water heater at least partially overlap each other, thereby heating the washing water and regenerating a moisture absorbent effectively and in a short time even in a washing course with a short washing cycle time.

20 Claims, 21 Drawing Sheets

DISHWASHER

CROSS-REFERENCE TO RELATED APPLICATION

This application claims priority to and benefit of Korean Patent Application No. 10-2023-0050083, filed on Apr. 17, 2023, and No. 10-2023-0124183, filed on Sep. 18, 2023, which is hereby incorporated by reference as when fully set forth herein.

BACKGROUND

Field

The present disclosure relates to a dishwasher. More specifically, the present disclosure relates to a dishwasher in which a regeneration heater and a washing water heater are controlled to operate simultaneously so that an operation period of the regeneration heater and an operation period of the washing water heater at least partially overlap each other, thereby heating the washing water and regenerating a moisture absorbent effectively and in a short time even in a washing course with a short washing cycle time.

Description of Related Art

A dishwasher is an apparatus that washes dishes and cooking utensils as washing targets stored therein by spraying washing water thereto. In this regard, the washing water may contain washing detergent.

A dishwasher generally includes a washing tub having a washing space defined therein, a dish rack that accommodates therein a washing target inside the washing tub, a spraying arm that sprays the washing water into the dish rack, and a sump that stores therein water and supplies the washing water to the spraying arm.

Using this dishwasher may allow a time and effort required to wash the dishes and other washing targets after a meal to be reduced, thereby contributing to user convenience.

Typically, the dishwasher is configured to perform a washing cycle for washing a washing target, a rinsing cycle for rinsing a washing target, and a drying cycle for drying a washing target that has been washed and rinsed.

Recently, a dishwasher equipped with a moisture-absorption device that may reduce a drying time of the washing target by absorbing water vapor contained in the air discharged from the tub during the drying cycle and then re-supplying the air to the tub has been released.

A moisture absorbent provided in the moisture-absorption device may perform a moisture absorption process of absorbing moisture in air flow during a drying cycle, and may be subjected to a regenerating process in which the moisture absorbent is dried by exposure to a high temperature flow after the drying cycle has been completed.

This moisture absorbent regenerating process usually occurs during a washing cycle.

The high temperature flow used to dry the moisture absorbent may be supplied to the tub and may be used to heat the washing water.

In some cases, a dishwasher is disclosed in which a high-temperature air flow is generated using a regeneration heater to regenerate the moisture absorbent during the washing cycle, and the high-temperature air flow continues to be supplied to the tub to heat the washing water to a target temperature even after the regenerating of the moisture absorbent has been completed.

In some cases, a dishwasher is disclosed in which during the washing cycle, the washing water is heated to a first temperature using a high temperature air flow used for regenerating the moisture absorbent, and then is heated to a second temperature using a separate washing water heater when of the regenerating of the moisture absorbent has been completed.

SUMMARY

The regeneration heater provided in the dishwasher disclosed in prior literature 001 and prior document 002 is used to heat the air flow, and thus is embodied as a heating element with a lower output of 30 to 60% of that of the washing water heater for heating the washing water and thus a lower heating efficiency of 75% of that of thereof.

Therefore, when the washing water to be used in the washing cycle is heated with only the regeneration heater, as in prior document 001, it takes much more time than that taken when the washing water is heated using the washing water heater. Thus, the former case has much lower energy efficiency than that of the latter case.

Instead, as in prior document 002, it is more efficient to heat the washing water using the regeneration heater and the washing water heater alternately during the washing cycle. However, when a washing course with a relatively short operating time of the washing cycle is selected, an operating time of the washing water heater cannot be secured if the regenerating time of the moisture absorbent is secured to perform perfect regenerating, whereas if the operating time of the washing water heater is secured, the regenerating of the moisture absorbent may be incomplete.

The present disclosure has been designed to solve the problems of the prior art as described above. Thus, a first purpose of the present discourse is to provide a dishwasher in which a regeneration heater and a washing water heater simultaneously operate such that an operation period of the regeneration heater and an operation period of the washing water heater at least partially overlap each other, thereby heating the washing water and regenerating the moisture absorbent effectively and in a short time even in a washing course with a short washing cycle time.

Moreover, a second purpose of the present discourse is to provide a dishwasher in which when regenerating of the moisture absorbent is incomplete during the washing cycle, the regeneration heater is controlled to operate during a rinse cycle or a heating rinse cycle, and during a water supply cycle and a water discharge cycle, thereby securing an operation time of the regeneration heater regardless of the operation of the washing water heater and thus securing the regenerating time of the moisture absorbent regardless of the washing condition and the washing course.

Moreover, a third purpose of the present discourse is to provide a dishwasher in which a power supply is controlled to supply power with a lower voltage to the regeneration heater or the washing water heater so that an output current of the power supply that supplies the power to the regeneration heater and the washing water heater does not exceed the allowable output of the power supply during a simultaneous operation process in which the regeneration heater and the washing water heater simultaneously operate, thereby preventing overload in the power supply and thus improving the safety and reliability of the product.

Purposes of the present disclosure are not limited to the above-mentioned purpose. Other purposes and advantages of the present disclosure that are not mentioned may be understood based on following descriptions, and may be more clearly understood based on embodiments of the present disclosure. Further, it will be easily understood that the purposes and advantages of the present disclosure may be realized using means shown in the claims and combinations thereof.

One aspect of the present disclosure provides a dishwasher comprising a tub having a washing space defined therein and constructed to accommodate therein a dish; and a sorption drying device including: a moisture absorbent for absorbing water vapor contained in air discharged from the tub; and a regeneration heater configured to heat air to be supplied to the moisture absorbent to dry the moisture absorbent; a washing water configured to heat washing water to be supplied to the washing space; and a controller configured to perform at least one course among a plurality of courses, each course including a combination of cycles for washing the dish, wherein the controller is configured to: in response to that a first course is selected from among the plurality of courses, perform the first course in a first mode including a non-simultaneous operation process in which power is non-simultaneously supplied to each of the regeneration heater and the washing water heater; or in response to that a second course is selected from among the plurality of courses, perform the second course in a second mode including a simultaneous operation process in which the power is simultaneously supplied to the regeneration heater and the washing water heater.

In one embodiment of the dishwasher, an operating time of the second course is shorter than an operating time of the first course.

In one embodiment of the dishwasher, an operating time of the second course is smaller than or equal to 1 hour.

In one embodiment of the dishwasher, the cycles include a washing cycle, wherein the controller is further configured to: in response to that the second course is selected from among the plurality of courses, perform the washing cycle included in the second course by supplying the power to the regeneration heater and the washing water heater while the washing cycle included in the second course is being performed.

In one embodiment of the dishwasher, the controller is further configured to maintain the power supply to the regeneration heater during a water discharge cycle executed after the washing cycle has been completed.

In one embodiment of the dishwasher, the cycles include a rinse cycle, wherein the controller is further configured to: in response to that the second course is selected from among the plurality of courses, perform the rinse cycle included in the second course by supplying the power to the regeneration heater while the rinse cycle included in the second course is being performed.

In one embodiment of the dishwasher, the controller is further configured to maintain the power supply to the regeneration heater during a water discharge cycle and a water supply cycle executed after the rinse cycle included in the second course has been completed.

In one embodiment of the dishwasher, the cycles include a heating rinse cycle, in response to that the second course is selected from among the plurality of courses, perform the heating rinse cycle included in the second course by simultaneously supplying the power to the regeneration heater and the washing water heater while the heating rinse cycle included in the second course is being performed.

In one embodiment of the dishwasher, the controller is further configured to maintain the power supply to the regeneration heater during a water discharge cycle executed after the heating rinse cycle included in the second course has been completed.

In one embodiment of the dishwasher, the simultaneous operation process includes a process of supplying the power to the regeneration heater and the washing water heater to turn on the regeneration heater and the washing water heater simultaneously, or a process of supplying the power to the regeneration heater and the washing water heater to turn on the regeneration heater and the washing water heater sequentially.

In one embodiment of the dishwasher, the simultaneous operation process includes, after the regeneration heater and the washing water heater have been turned on simultaneously or sequentially, a process of simultaneously turning off the regeneration heater and the washing water heater by simultaneously cutting off the power supplied to the regeneration heater and the washing water heater.

In one embodiment of the dishwasher, the simultaneous operation process includes, before simultaneously turning off the regeneration heater and the washing water heater: a process of turning off the regeneration heater by cutting off the power supplied to the regeneration heater; and a process of turning the regeneration heater back on by re-supplying the power to the regeneration heater after the regeneration heater has been turned off.

In one embodiment of the dishwasher, the simultaneous operation process includes, after the regeneration heater and the washing water heater have been turned on simultaneously or sequentially, a process of sequentially turning off the regeneration heater and the washing water heater by sequentially cutting off the power supplied to the regeneration heater and the washing water heater.

In one embodiment of the dishwasher, the controller is further configured to: after the process of supplying the power to the regeneration heater and the washing water heater to turn the regeneration heater and the washing water heater on simultaneously, or the process of supplying the power to the regeneration heater and the washing water heater to sequentially turn on the regeneration heater and the washing water heater, in response to that both the regeneration heater and the washing water heater have been turned on, adjust a voltage of the power supplied to the regeneration heater and the washing water heater so that an output current of the power supply supplying the power to the regeneration heater and the washing water heater does not exceed a preset allowable output current.

In one embodiment of the dishwasher, the controller is further configured to: control the power supply to supply the power of a first voltage to the regeneration heater or the washing water heater in a state in which either the regeneration heater or the washing water heater has been turned on; and control the power supply to supply the power of a second voltage smaller than or equal to the first voltage to the regeneration heater or the washing water heater in a state in which both the regeneration heater and the washing water heater have been turned on.

In one embodiment of the dishwasher, the washing water heater includes a variable capacity heater configured to: when the power of the first voltage is supplied thereto, generate an output of 1100 W to 1300 W; and when the power of the second voltage is supplied thereto, generate an output of 700 W to 900 W.

In one embodiment of the dishwasher, the variable capacity heater includes at least one of a sheath heater, a carbon heater, or a ceramic heater.

In one embodiment of the dishwasher, the power supply includes a variable transformer configured to be capable of adjusting an output voltage thereof such that the first voltage is in a range from 110V to 130V, and the second voltage is in a range from 90V to 100V.

In the dishwasher in accordance with the present discourse, the regeneration heater and the washing water heater simultaneously operate such that an operation period of the regeneration heater and an operation period of the washing water heater at least partially overlap each other, thereby heating the washing water and regenerating the moisture absorbent effectively and in a short time even in a washing course with a short washing cycle time.

Moreover, in the dishwasher in accordance with the present discourse, when regenerating of the moisture absorbent is incomplete during the washing cycle, the regeneration heater is controlled to operate during a rinse cycle or a heating rinse cycle, and during a water supply cycle and a water discharge cycle, thereby securing an operation time of the regeneration heater regardless of the operation of the washing water heater and thus securing the regenerating time of the moisture absorbent regardless of the washing condition and the washing course.

Moreover, in the dishwasher in accordance with the present discourse, the power supply is controlled to supply power with a lower voltage to the regeneration heater or the washing water heater so that an output current of the power supply that supplies the power to the regeneration heater and the washing water heater does not exceed the allowable output of the power supply during a simultaneous operation process in which the regeneration heater and the washing water heater simultaneously operate, thereby preventing overload in the power supply and thus improving the safety and reliability of the product.

In addition to the above-mentioned effects, the specific effects of the present disclosure as not mentioned will be described below along with the descriptions of the specific details for carrying out the present disclosure.

DETAILED DESCRIPTIONS

Figure 1:
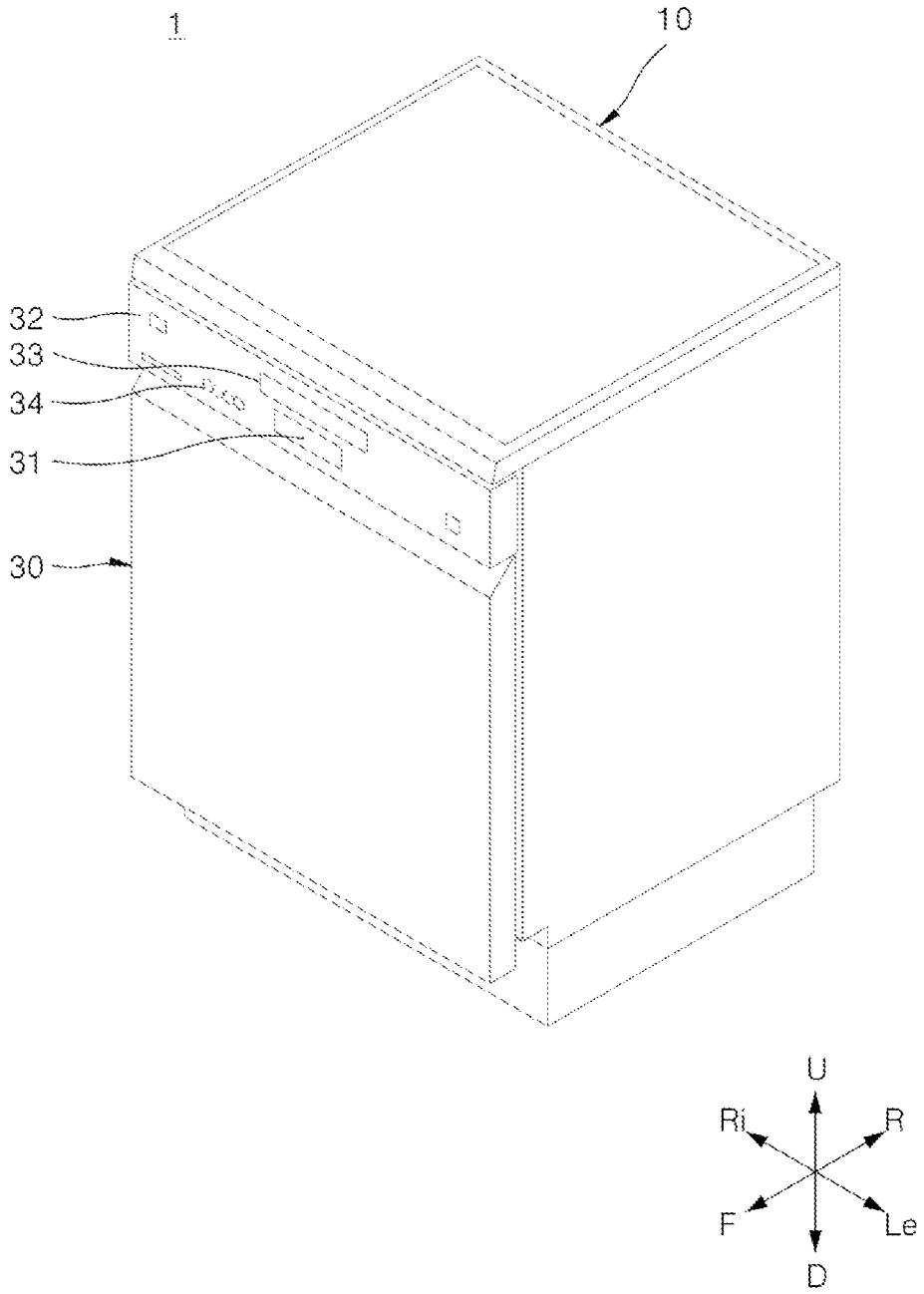
FIG. 1 is a front perspective view of a dishwasher according to one embodiment of the present disclosure.

The above-mentioned purpose, features and advantages are described in detail below with reference to the attached drawings. Accordingly, a person skilled in the art in the technical field to which the present disclosure belongs will be able to easily implement the technical idea of the present disclosure. In describing the present disclosure, when it is determined that a detailed description of the known technology related to the present disclosure may unnecessarily obscure the gist of the present disclosure, the detailed description thereof is omitted. Hereinafter, preferred embodiments according to the present disclosure will be described in detail with reference to the attached drawings. In the drawings, identical reference numerals are used to indicate identical or similar components.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

The terminology used herein is directed to the purpose of describing particular embodiments only and is not intended to be limiting of the present disclosure. As used herein, the singular constitutes "a" and "an" are intended to include the plural constitutes as well, unless the context clearly indicates otherwise.

It will also be understood that when a first element or layer is referred to as being present "on" a second element or layer, the first element may be disposed directly on the second element or may be disposed indirectly on the second element with a third element or layer being disposed between the first and second elements or layers. It will also be understood that when a first element or layer is referred to as being present "under" a second element or layer, the first element may be disposed directly under the second element or may be disposed indirectly under the second element with a third element or layer being disposed between the first and second elements or layers.

It will be understood that when an element or layer is referred to as being "connected to", or "coupled to" another element or layer, it may be directly connected to or coupled to another element or layer, or one or more intervening elements or layers therebetween may be present. In addition, it will also be understood that when an element or layer is referred to as being "between" two elements or layers, it may be the only element or layer between the two elements or layers, or one or more intervening elements or layers therebetween may also be present.

It will be further understood that the terms "comprise", "comprising", "include", and "including" when used in this specification, specify the presence of the stated features, integers, operations, elements, and/or components, but do not preclude the presence or addition of one or more other features, integers, operations, elements, components, and/or portions thereof. As used herein, the term "and/or" includes any and all combinations of one or more of associated listed items. Expression such as "at least one of" when preceding a list of elements may modify the entire list of elements and may not modify the individual elements of the list. In interpretation of numerical values, an error or tolerance therein may occur even when there is no explicit description thereof.

Spatially relative terms, such as "beneath," "below," "lower," "under," "above," "upper," and the like, may be used herein for ease of explanation to describe one element or feature's relationship to another element or feature as illustrated in the figures. It will be understood that the spatially relative terms are intended to encompass different orientations of the device in use or in operation, in addition to the orientation depicted in the figures. For example, when the device in the drawings may be turned over, elements described as "below" or "beneath" or "under" other elements or features would then be oriented "above" the other elements or features. Thus, the example terms "below" and "under" may encompass both an orientation of above and below. The device may be otherwise oriented for example, rotated 90 degrees or at other orientations, and the spatially relative descriptors used herein should be interpreted accordingly.

As used herein, "A and/or B" means A, B or A and B, unless specifically stated otherwise. Expression such as "at least one of" when preceding a list of elements may modify the entirety of list of elements and may not modify the individual elements of the list. As used herein, "C to D" means C inclusive to D inclusive unless otherwise specified.

Hereinafter, the present disclosure will be described with reference to drawings showing a configuration according to an embodiment of the present disclosure.

Overall Structure of the Dishwasher

Hereinafter, an overall structure of a dishwasher 1 according to an embodiment of the present disclosure will be described in detail with reference to the attached drawings.

Figure 2:
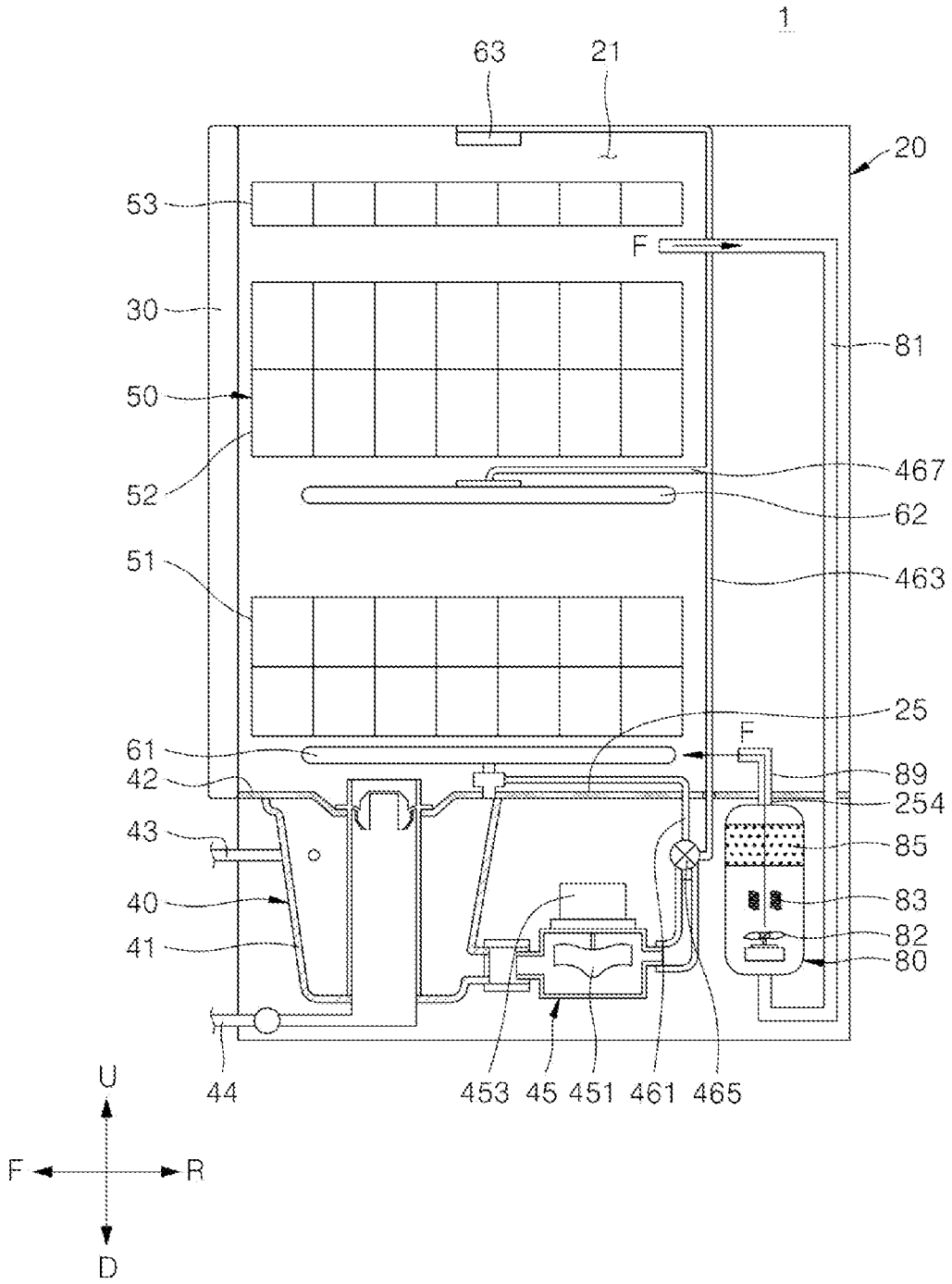
FIG. 2 is a schematic cross-sectional view of the dishwasher as shown in FIG. 1.
Figure 3:
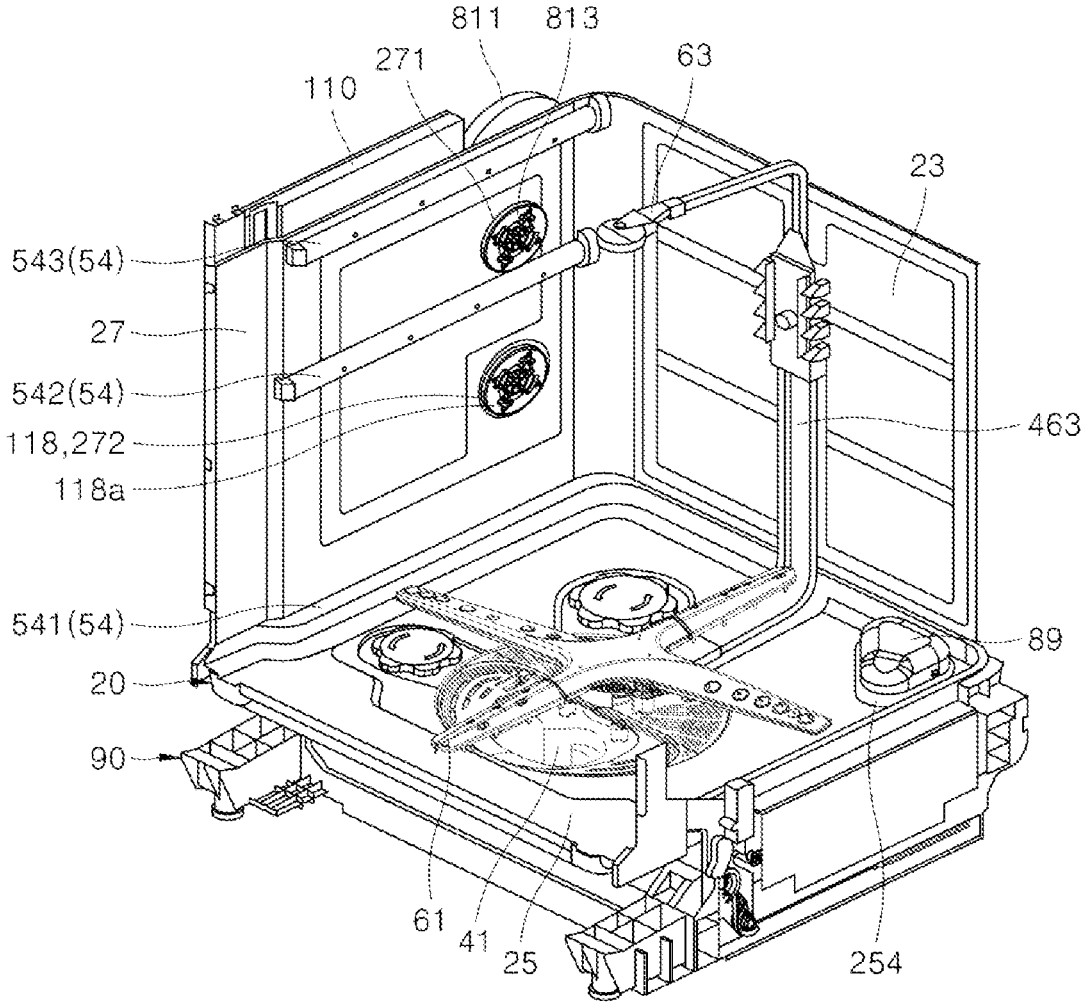
FIG. 3 is a front perspective view showing a state in which a door of the dishwasher as shown in FIG. 1 is opened.

FIG. 1 is a front perspective view showing the dishwasher according to the present disclosure. FIG. 2 is a simplified cross-sectional view briefly showing an internal structure of the dishwasher according to the present disclosure. FIG. 3 is a front perspective view showing a state in which a door 30 of the dishwasher 1 as shown in FIG. 1 is in an open state.

As shown in FIG. 1 to FIG. 3, the dishwasher 1 according to the present disclosure may include a casing 10 that constitutes an exterior appearance, a tub 20 installed in an inner space of the casing 10 and having a washing space 21 defined therein where the washing target is washed, wherein a front surface of the tub is open, a door 30 that opens/closes the open front surface of the tub 20, a driver 40 located under the tub 20 to supply, collect, circulate, and discharge the washing water for washing the washing target, a dish rack 50 removably provided in the inner washing space 21 of the tub 20 to receive therein the washing target, and a water sprayer 60 installed adjacent to the dish rack 50 to spray the washing water for washing the washing target thereto.

In this regard, the washing target received in the dish rack 50 may be, for example, dishes such as bowls, plates, spoons, and chopsticks, and other cooking utensils. Hereinafter, unless otherwise specified, the washing target will be referred to as a dish.

The tub 20 may be formed in a box shape with an entirely open front surface, and have a configuration of a so-called washing tub.

The washing space 21 may be defined inside the tub 20. The open front surface of the tub 20 may be opened/closing by the door 30.

The tub 20 may be formed via pressing of a metal plate resistant to high temperature and moisture, for example, a stainless steel plate.

Moreover, on an inner surface of the tub 20, a plurality of brackets may be disposed for the purpose of supporting and installing functional components such as the dish rack 50 and the water sprayer 60 which will be described later thereon within the tub 20.

In one example, the driver 40 may include a sump 41 that stores therein washing water, a sump cover 42 that distinguishes the sump 41 from the tub 20, a water supply 43 that supplies washing water from an external source to the sump 41, a water discharger 44 that discharges the washing water of the sump 41 to an outside, and a washing pump 45 and a supply flow path 46 that supply the washing water of the sump 41 to the water sprayer 60. The sump cover 42 may be disposed at a top of the sump 41 and may serve to distinguish the tub 20 and the sump 41 from each other. Moreover, the sump cover 42 may have a plurality of collecting holes defined therein for collecting washing water sprayed into the washing space 21 through the water sprayer 60 into the sump 41.

That is, the washing water sprayed from the water sprayer 60 toward the dish may fall down to a bottom of the washing space 21, and may be collected again through the sump cover 42 and into the sump 41.

The washing pump 45 may be disposed at a side or a bottom of the sump 41 and may serve to pressurize the washing water and supply the pressurized washing water to the water sprayer 60.

One end of the washing pump 45 may be connected to the sump 41 and the other end thereof may be connected to the supply flow path 46. The washing pump 45 may be equipped with an impeller 451 and a motor 453. When power is supplied to the motor 453, the impeller 451 may rotate, and thus the washing water in the sump 41 may be pressurized, and then may be supplied to the water sprayer 60 through the supply flow path 46.

In some implementations, the washing pump 45 may be equipped with a washing water heater to heat the washing water supplied during a washing cycle or a heating rinse cycle. Details on the washing water heater are described later with reference to FIG. 14 below.

In one example, the supply flow path 46 may serve to selectively supply the washing water supplied from the washing pump 45 to the water sprayer 60.

For example, the supply flow path 46 may include a first supply flow path 461 connected to a lower spraying arm 61, and a second supply flow path 463 connected to an upper spraying arm 62 and a top nozzle 63. The supply flow path 46 may be provided with a supply flow path switching valve 465 that selectively opens/closes the supply flow paths 461 and 463.

In this regard, the supply flow path switching valve 465 may be controlled so that the supply flow paths 461 and 463 are opened sequentially or simultaneously.

In one example, the water sprayer 60 may be constructed to spray the washing water to the dishes stored in the dish rack 50.

More specifically, the water sprayer 60 may include the lower spraying arm 61 located under the tub 20 to spray the washing water to a lower rack 51, the upper spraying arm 62 located between the lower rack 51 and an upper rack 52 to spray the washing water to the lower rack 51 and the upper rack 52, and the top nozzle 63 located on top of the tub 20 to spray the washing water to a top rack 53 or the upper rack 52.

In particular, the lower spraying arm 61 and the upper spraying arm 62 may be rotatably disposed in the washing space 21 of the tub 20 and may spray the washing water toward the dish of the dish rack 50 while being rotating.

The lower spraying arm 61 may be rotatably supported on a top of the sump cover 42 so as to spray the washing water toward the lower rack 51 while being rotating and being disposed under the lower rack 51.

Moreover, the upper spraying arm 62 may be rotatably supported by a spraying arm holder 467 so as to spray the washing water on the dish while being rotating and being disposed between the lower rack 51 and the upper rack 52.

In one example, in order to increase washing efficiency, additional means for diverting the washing water sprayed from the lower spraying arm 61 into an upward direction (diverting in a U-direction) may be provided at a lower surface 25 of the tub 20.

Since a configuration already known in the art may be applied to a detailed configuration of the water sprayer 60, description of a specific configuration of the water sprayer 60 will be omitted below.

The dish rack 50 for storing the dish therein may be disposed in the washing space 21.

The dish rack 50 may be constructed to extend or retract from or into the inner space of the tub 20 through the open front surface of the tub 20.

For example, in FIG. 2, an embodiment is shown in which the dish rack 50 includes the lower rack 51 located at a lower portion of the tub 20 to accommodate therein relatively large dishes, the upper rack 5 located on top of the lower rack 51 to accommodate therein medium-sized dishes, and the top rack 53 located at a top level of the tub 20 and capable of storing therein small dishes, etc. However, the present disclosure is not limited thereto. However, hereinafter, an example in which the dishwasher includes the three dish racks 50 as shown is described.

Each of the lower rack 51, the upper rack 52, and the top rack 53 may be constructed to extend or retract from or into the inner space of the tub 20 through the open front surface of the tub 20.

For this purpose, guide rails may be respectively disposed on both opposing walls constituting an inner surface of the tub 20. By way of example, the guide rails 54 may include an upper rail, a lower rail, and a top rail.

Wheels may be disposed on a bottom of each of the lower rack 51, the upper rack 52, and the top rack 53. The user may extend the lower rack 51, the upper rack 52, and the top rack 53 from the inner space of the tub 20 through the open front surface of the tub 20 and may place the dishes thereon, or easily withdraw the dishes that have been washed out thereof.

The guide rail 54 may be embodied as a simple rail-type fixed guide rail to guide the extending or the retracting of the rack 50, or a telescopic guide rail capable of guiding the extending or the retracting of the rack 50 and at the same time, increasing an extension distance thereof as the rack 50 further extends from the inner space of the tub.

In one example, the door 30 is configured for opening/closing the open front surface of the tub 20 as described above.

A hinge around which the door 30 is closed or opened may be provided at a bottom of the open front surface. Thus, the door 30 may pivot around the hinge as a pivot axis.

In this regard, a handle 31 for opening the door 30 and a control panel 32 for controlling the dishwasher 1 may be disposed on an outer side surface of the door 30.

As shown, the control panel 32 may include a display 33 that visually displays information regarding a current operating status of the dishwasher, etc., and a button interface 34 including a selection button through which a course selection manipulation by the user is input and a power button through which a user's manipulation for turning the dishwasher on and off is input.

In one example, an inner side surface of the door 30 may constitute one side surface of the tub 20 when the door 30 has been closed, and may constitute a seat surface on which the lower rack 51 of the dish rack 50 is supported when the door 30 is fully opened.

For this purpose, when the door 30 is fully opened downwardly, the inner side surface of the door 30 may constitute a horizontal plane extending in the same direction as a direction in which the guide rail 54 guiding the displacement of the lower rack 51 extends.

In one example, a washing detergent supply device to automatically supply washing detergent to the inner space of the tub 20 may be disposed on the inner side surface of the door 30.

In one example, under the tub 20, a sorption drying device 80 may be disposed which absorbs water vapor contained in the air discharged from the tub 20 during the drying cycle and then re-supplies the air back to the tub 20. The Sorption drying device may also be referred to similar terms such as moisture-absorption device, adsorption device, and sorption device.

As shown, the sorption drying device 80 may be configured to include an air intake duct 81 through which the air discharged from the tub 20 is sucked, a blower 82 that generates a flow of air, a heating unit 83 that heats the air sucked from the tub 20 and a moisture absorbent 85 that absorbs the water vapor contained in the air.

As described later, the lower surface 25 of the tub 20 may have an air supply hole 254 through which the air from which the water vapor has been removed using the sorption drying device 80 is introduced into the inner space of the tub 20.

Moreover, as shown in FIG. 3, a grill cap 8113 coupled to an inlet of the air intake duct 81 may be fixed to one side surface of the tub 20, for example, to a right side surface thereof.

A detailed configuration of the sorption drying device 80 will be described later with reference to FIG. 4 below.

Detailed Composition of Sorption Drying Device

Hereinafter, with reference to FIG. 3 to FIG. 13, the detailed configuration of the sorption drying device 80 according to an embodiment of the present disclosure is described.

First, as shown in FIGS. 3 to 6, remaining parts of the sorption drying device 80 excluding a main duct 811 of the air intake duct 81 and a discharge guide 89 may be disposed to be accommodated between a base 90 and the lower surface 25 of the tub 20 and may be supported on a lower surface 91 of the base 90.

For example, the blower 82, the heater 83, and the housing 84 of the sorption drying device 80 may be disposed adjacent to a rear surface 93 of the base 90, and may be arranged in a parallel manner to a length of the rear surface 93 of the base 90.

A position of the sorption drying device 80 may be selected in consideration of characteristics of the heating unit 83 of the sorption drying device 80 which generates high heat of approximately 200° C. or higher in a moisture absorbent drying mode or a moisture absorbent regenerating mode. In other words, the position of the sorption drying device 80 may be selected as a position other than positions of electrical components that are relatively affected by the high heat.

In this way, the blower 82, the heater 83, and the housing 84 of the sorption drying device 80 may be adjacent to the rear surface 93 of the base 90 and may be arranged in a parallel manner to a length of the rear surface 93 of the base 90. Thus, when the door 30 is fully opened downwardly, a weight balance state may be achieved to prevent the dishwasher 1 from tilting due to a load of the door 30.

Figure 4:
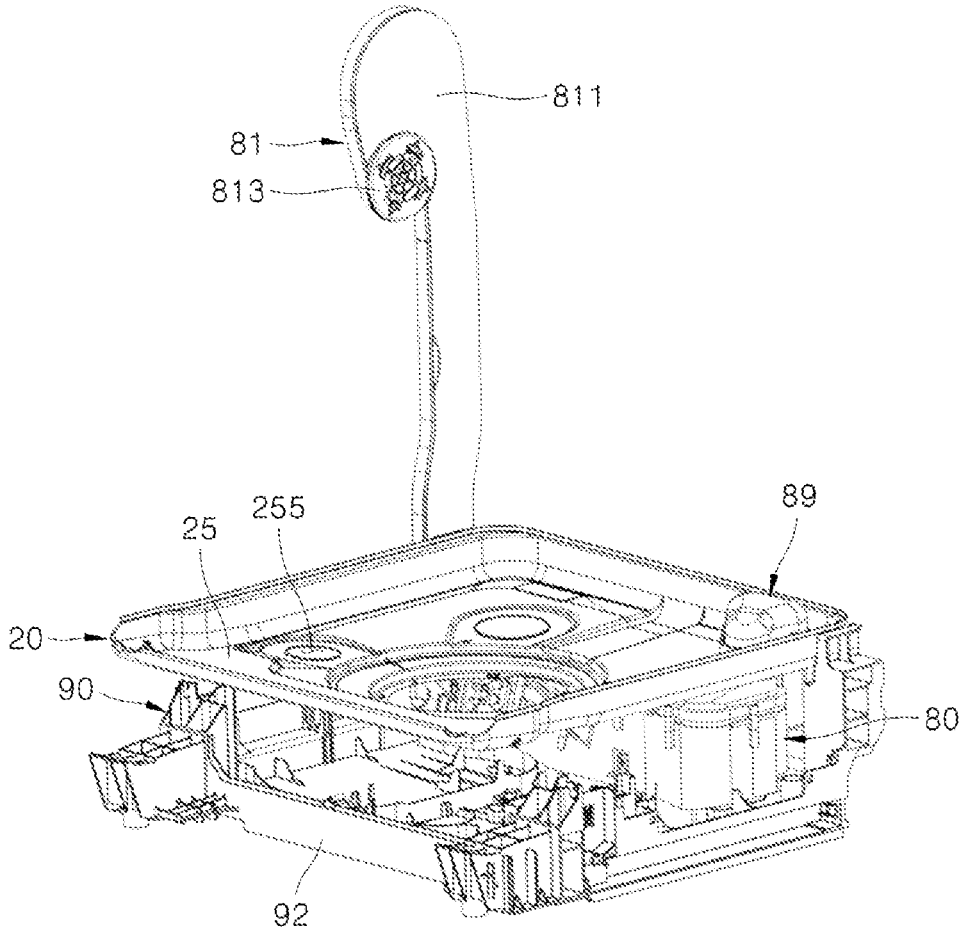
FIG. 4 is a front perspective view showing a state in which a sorption drying device of the dishwasher according to an embodiment of the present disclosure is accommodated in a base.
Figure 5:
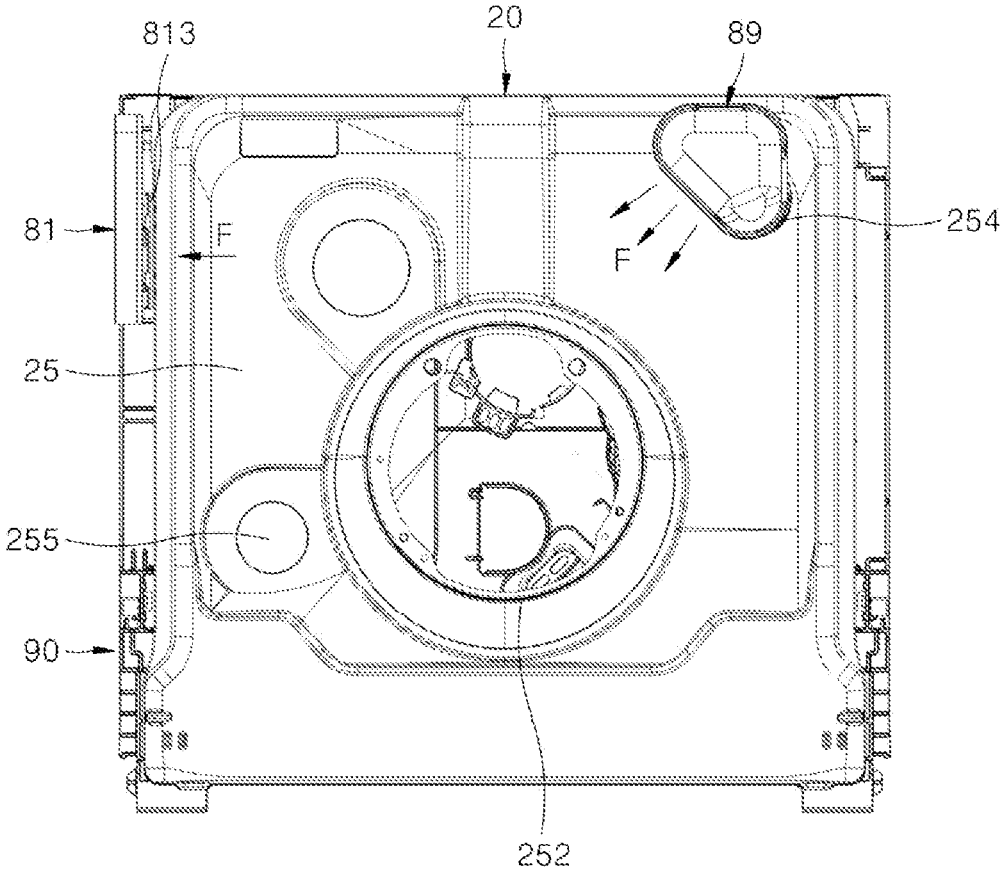
FIG. 5 is a plan view of FIG. 4.
Figure 6:
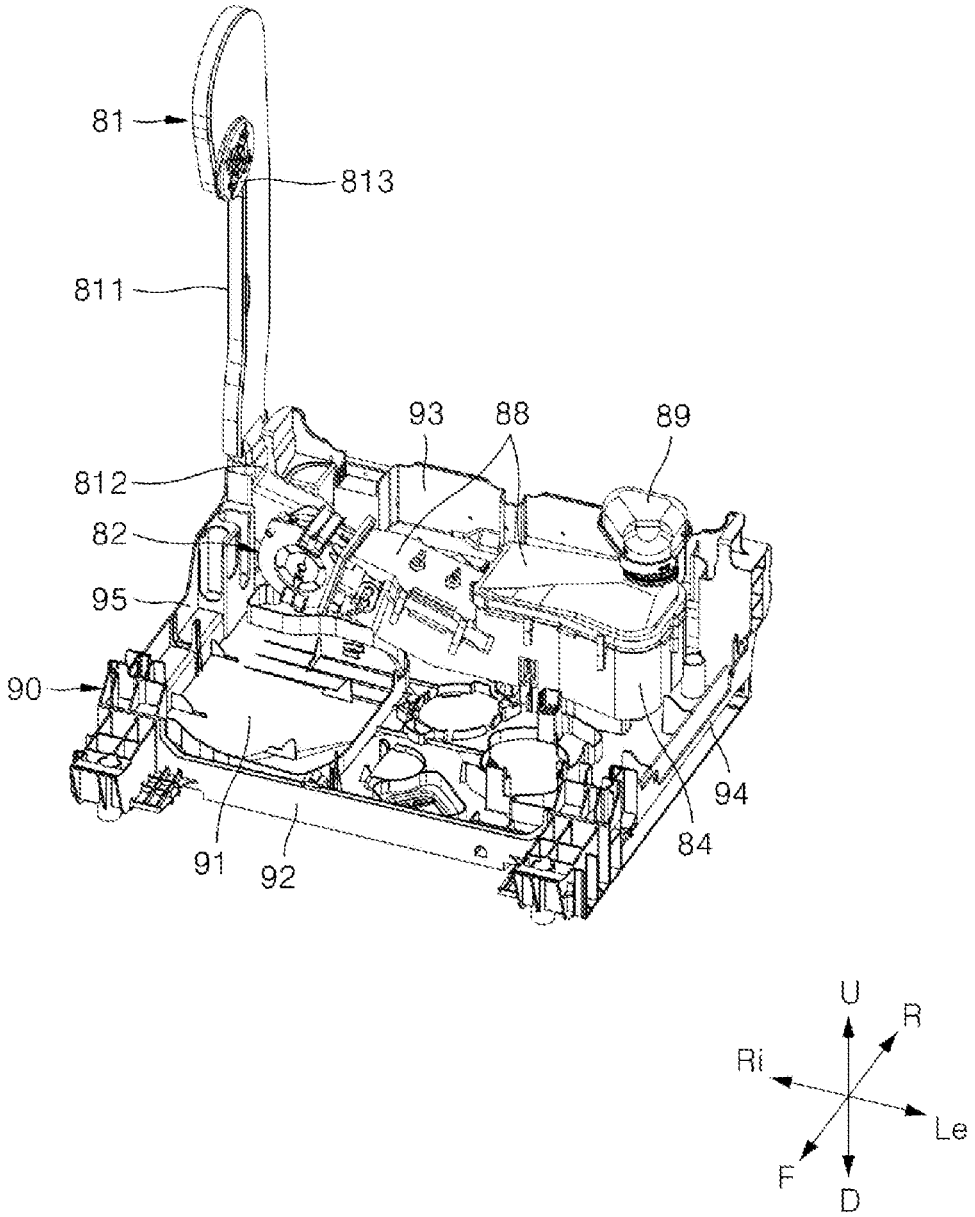
FIG. 6 is a front perspective view showing a state in which a tub has been removed in FIG. 4.

Moreover, as shown in FIGS. 3 to 5, the position of the device 80 may be selected based on a location of the air supply hole 254 formed in the lower surface 25 of the tub 20. In consideration of user safety and in order to distinguish the air supply hole 254 from the water softener communication hole 255 located close to the front surface of the tub 20, the air supply hole 254 through which dry air is discharged may be formed in the lower surface 25 of the tub 20 and adjacent to a corner at which a rear surface and a left side surface meet each other.

The air supplied through the air supply hole 254 may be evenly distributed to the washing space 21 of the tub 20 through the discharge guide 89 exposed to the washing space 21.

In order to effectively supply the air from which the moisture has been absorbed to the air supply hole 254 formed at this location, the housing 84 of the sorption drying device 80 that accommodates therein the moisture absorbent 85 may be disposed close to the air supply hole 254 and under the air supply hole 254.

However, the position of the sorption drying device 80 is only an example. The present disclosure is not limited thereto. Alternatively, the sorption drying device 80 may be located adjacent to a left side surface 94, a right side surface 95, or a front surface 92 rather than the rear surface 93 of the base 90. The present disclosure is not limited thereto. Hereinafter, the description will be based on an embodiment in which the sorption drying device 80 is disposed adjacent to the rear surface 93 of the base 90 and extends in a parallel manner to the length of the rear surface 93 of the base 90.

In one example, as shown in FIG. 3 to FIG. 6, the blower 82, the heater 83, and housing 84 of the sorption drying device 80 may be disposed adjacent to the rear surface 93 of the base 90 and may be arranged in a parallel manner to the length of the rear surface 93 of the base 90. The air supply hole 254 may be formed adjacent to a corner at which the rear surface and the left side surface meet each other and in the lower surface 25 of the tub 20. In this case, an air intake hole 271 through which humid air is discharged from the tub 20 may be defined in a right side surface of the tub 20 and adjacent to a corner where the right side surface and the rear surface meet each other, and may be formed at a position close to an upper surface 24 of the tub 20.

The location of this air intake hole 271 may be selected as a location spaced as far as possible from the air supply hole 254 formed in the lower surface 25 of the tub 20. In this way, the air intake hole 271 may be positioned so as to be as far as possible from the air supply hole 254 and the discharge guide 89. Thus, a possibility at which the air that has passed through the air supply hole 254 and the discharge guide 89 re-flows directly into the air intake hole 271 without passing through the washing target may be significantly reduced.

Moreover, the air intake hole 271 may be located at a higher position in a vertical direction than that of the upper rail 542 constituting the guide rail 54, for example, may be positioned between the top rail 543 and the upper rail 542.

Therefore, the air intake hole 271 may be formed at a higher position in the vertical direction than that of the upper rack 52 mounted on the upper rail 542 and moving along the upper rail 542. Thus, air flow F in the washing space 21 may be guided such that the air evenly flows through the lower rack 51 and the upper rack 52 and then flows into the air intake hole 271.

Moreover, as shown in FIG. 3, the air intake hole 271 together with the main duct 811 which will be described later may be located in rear of a water jacket 110 where the washing water to be supplied to the sump 41 where the washing water is stored is stored.

In this regard, as shown, a tub hole 118 may be formed in the water jacket 110 to communicate an internal space of the water jacket with the washing space 21 of the tub 20. A water jacket communication hole 272 may be defined in the right side surface 27 of the tub 20 in a corresponding manner to the tub hole 118.

The air intake hole 271 may be defined at a position other than a position of the water jacket 110 and may be formed at a higher position than that of the water jacket communication hole 272.

As shown, a grill cap 118*a* similar in shape to the grill cap 813 of the air intake hole 271 as described above may be coupled to the tub hole 118 to minimize inflow of the washing water and prevent inflow of foreign substances.

In one example, the grill cap 813 may be coupled to the air intake hole 271. Thus, the grill cap 813 may allow the washing water and foreign substances scattered from the inner space of the tub 20 from inflowing into the air intake duct 81 at a minimized level.

As will be described later, the grill cap 813 may pass through the air intake hole 271 and be coupled to an inlet 811*a* of the main duct 811 constituting the air intake duct 81.

FIGS. 7 to 13 show a detailed configuration of the sorption drying device 80.

As shown, the sorption drying device 80 may be configured include the blower 82 that generates flow F of air sucked from the tub 20 and to be supplied to the inner space of the tub 20, the heating unit 83 including the heater 831 that heats air to be supplied to the absorbent 85, a plurality of moisture absorbents 85 disposed downstream of the blower 82 and the heating unit 83 in a flow direction of air and absorb moisture contained in the air, the housing 84 having a heater receiving space S1 in which the heating unit 83 is accommodated and a moisture absorbent receiving space S3 in which the moisture absorbent 85 is accommodated, the air intake duct 81 connecting the air intake hole of the tub 20 and the blower 82 to each other, and the discharge guide 89 guiding a direction in which the air exposed to the inner space of the tub 20 and flowing through the moisture absorbent 85 is discharged.

The blower 82 may be disposed upstream of the heating unit 83 and the moisture absorbent 85 in the flow direction of the air flow F, and may be disposed downstream of the air intake duct 81 in the flow direction of the air flow F and may suck the air from the tub 20, and may generate the air flow F so that the sucked air may pass through the moisture absorbent 85.

A blow fan and a blower motor that generates a rotational driving force of the blow fan may be modularized together to form an assembly accommodated inside a fan housing 821.

The fan housing 821 may be fixed to a main housing 841 which will be described later via a connecting bracket 822.

Figure 9:
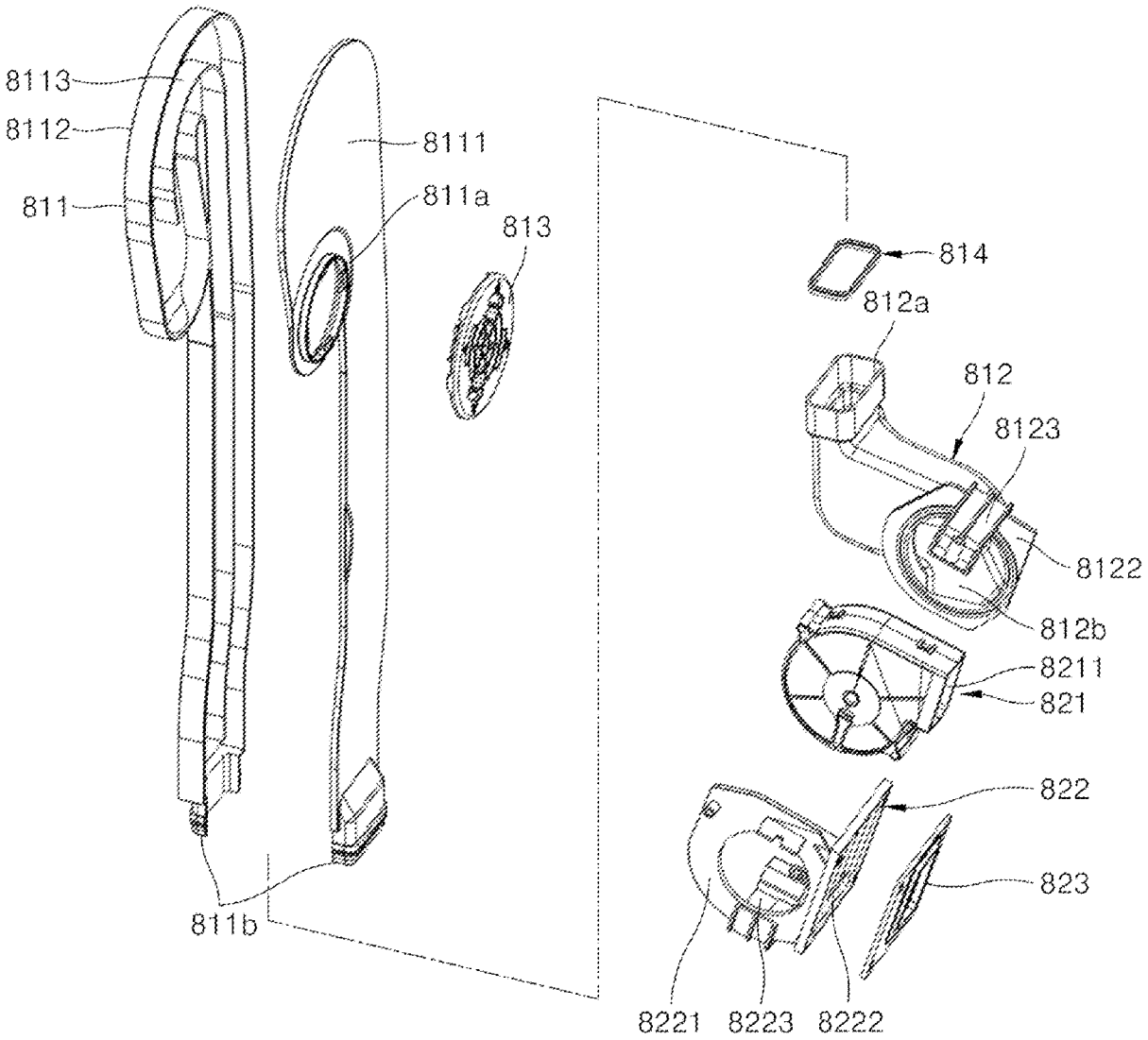
FIG. 9 is an exploded perspective view of an air intake duct and a blower of the sorption drying device as shown in FIG. 7.

As shown in FIG. 9, the connecting bracket 822 may include a fan connector 8221 in a shape of a circular plate coupled to one side surface of the fan housing 821, a rectangle plate-shaped housing connector 8222 coupled to an inlet IN1 of the main housing 841, and a bridge 8223 having one end fixed to the fan connector 8221, and extending in a bar shape and having the other end fixed to the other side surface of the fan housing 821.

The fan connector 8221 may be provided in a circular plate shape corresponding to a shape of one side surface of the fan housing 821, and may be fastened to the fan housing 821 using fastening means such as a screw bolt while being in surface contact with one side surface of the fan housing 821.

The housing connector 8222 may extend substantially perpendicular to the extension direction of the fan connector 8221 and may be integrally connected to an outer edge of the fan connector 8221. Therefore, the housing connector 8222 and the fan connector 8221 may be coupled to each other to achieve an overall L-shape.

The housing connector 8222 may be provided in the shape of a rectangle plate with taking into account a shape of a front end of the main housing 841 where the inlet IN1 is formed, that is, a shape of a front end of a heater receiving portion 8411 of the main housing 841, as described later. The housing connector 8222 may be fastened to the front end of the heater receiving portion 8411 of the main housing 841 using fastening means such as a screw bolt.

Moreover, a rectangle hole may extend through the housing connector 8222 and may have a shape corresponding to a shape of a discharge hole 8211 of the fan housing 821 and a shape of the inlet IN1 of the heater receiving portion 8411 of the main housing 841.

The discharge hole 8211 of the fan housing 821 may extend through the rectangle hole formed in the housing connector 8222 and extend into the inlet IN1 of the main housing 841.

The bridge 8223 may have one end integrally connected to the fan connector 8221 and extend along a rotation axis of the blow fan and have the other end connected to the other side surface of the fan housing 821. In the other end of the bridge 8223, a fastening hole may be formed through which fastening means such as a screw bolt may pass. Therefore, a rigid fastening structure may be achieved in which the connecting bracket 822 is fastened to the other side surface of the fan housing 821 via the bridge 8223.

In one example, an auxiliary duct 812 constituting the air intake duct 81 may be coupled and fastened to the other side surface of the fan housing 821 where an intake hole is formed.

Moreover, as shown in FIG. 9, between the housing connector 8222 of the connecting bracket 822 and the front end of the heater receiving portion 8411 of the main housing 841, a gasket 823 which has a rectangle plate shape and is made of an elastic material may be disposed.

There is no limitation on a type of the blow fan applied to the sorption drying device 80. However, in one example, a sirocco fan is preferable in consideration of constraints in terms of a position and a space where the blow fan is installed.

In the illustrated embodiment, when the sirocco fan is applied, air guided through the auxiliary duct 812 of the intake duct 81 may be introduced through the other side surface of the fan housing 821, that is, a rear surface thereof into the fan in a direction parallel to a rotation axis from a center of the sirocco fan, and then, the air may be accelerated radially and outwardly, and then may be discharged through the discharge hole 8211.

The accelerated and discharged air may generate the air flow F and may flow through the inlet IN1 of the heater receiving portion 8411 of the main housing 841 and be introduced into the inner space of the heater housing 832, which will be described later.

As will be described later, the heater receiving portion 8411 may extend in a downward inclination in which a vertical dimension thereof gradually decreases as the heater receiving portion 8411 extends from a front end to a rear end thereof.

In this regard, the blower 82 is fastened to the front end of the heater receiving portion 8411 via the connecting bracket 822. Therefore, an outlet of the fan housing 821 and the inlet IN1 of the heater receiving portion 8411 may be located at a higher vertical level that a vertical level of a bottom surface 8412*a* of the moisture absorbent receiving portion 8412 formed at the lowest position in the inner space of the main housing 841, and may be disposed at a position that is further apart from the moisture absorbent 85 as described later in a length direction thereof.

Moreover, an area occupied by the blower 82 may overlap an area occupied by the moisture absorbent 85 and the moisture absorbent receiving space S3 which will be described later in the vertical direction.

Therefore, the blower 82 and the moisture absorbent 85 which have a relatively large weight may be disposed in a distributed manner along a longitudinal direction of the heater receiving portion 8411. A difference between vertical levels of the blower 82 and the moisture absorbent 85 may be minimized.

Accordingly, an attenuation effect of the vibration generated by the blower 82 and the vibration generated by other components of the dishwasher 1 may be improved.

Moreover, as will be described later, the blower 82 is disposed at a higher vertical level than that of the bottom surface 8412*a* of the moisture absorbent receiving portion 8412 which constitutes a lower end of the internal space formed by the moisture absorbent receiving portion 8412 and the heater receiving portion 8411. Thus, influence due to condensation of the moisture contained in the air flow F may be minimized.

The heating unit 83 may be disposed between the blower 82 and the moisture absorbent 85 as described above in the flow direction of the air flow F, and may play a role in heating the air flow F to dry and regenerate the moisture absorbent 85 in the moisture absorbent drying mode or the moisture absorbent regenerating mode.

When the sorption drying device 80 generates a high temperature air flow F in the moisture absorbent drying mode, power may be supplied to the heater 831 to heat the air flow F. When the sorption drying device 80 generates a low-temperature air flow F in the moisture-absorption mode, the power supplied to the heater 831 may be cut off such that an operation of the heater 831 may be stopped.

In this regard, when the low-temperature air flow F is generated in the moisture-absorption mode, an operation of the blower motor may be maintained.

There is no limitation on the type of the heater 831 provided in the sorption drying device 80 according to an embodiment of the present disclosure. For example, a tube-shaped sheath heater that has a relatively simple structure, has excellent heat generation efficiency, and is advantageous in preventing electric leakage due to the washing water flowing from the tub 20 may be selected.

In order to distinguish the heater 831 from the washing water heater as described above, and with considering that the heater 831 operates only in drying and regenerating the moisture absorbent, the heater 831 provided in the heating unit 83 will hereinafter be referred to as a regeneration heater.

In order to increase the heat exchange efficiency, a heater body 8311 as the sheath heater may be directly exposed to the air flow F of the air in an inner air passage of the heater housing 832, and may be bent multiple times to maximize a heat transfer area.

Figure 13:
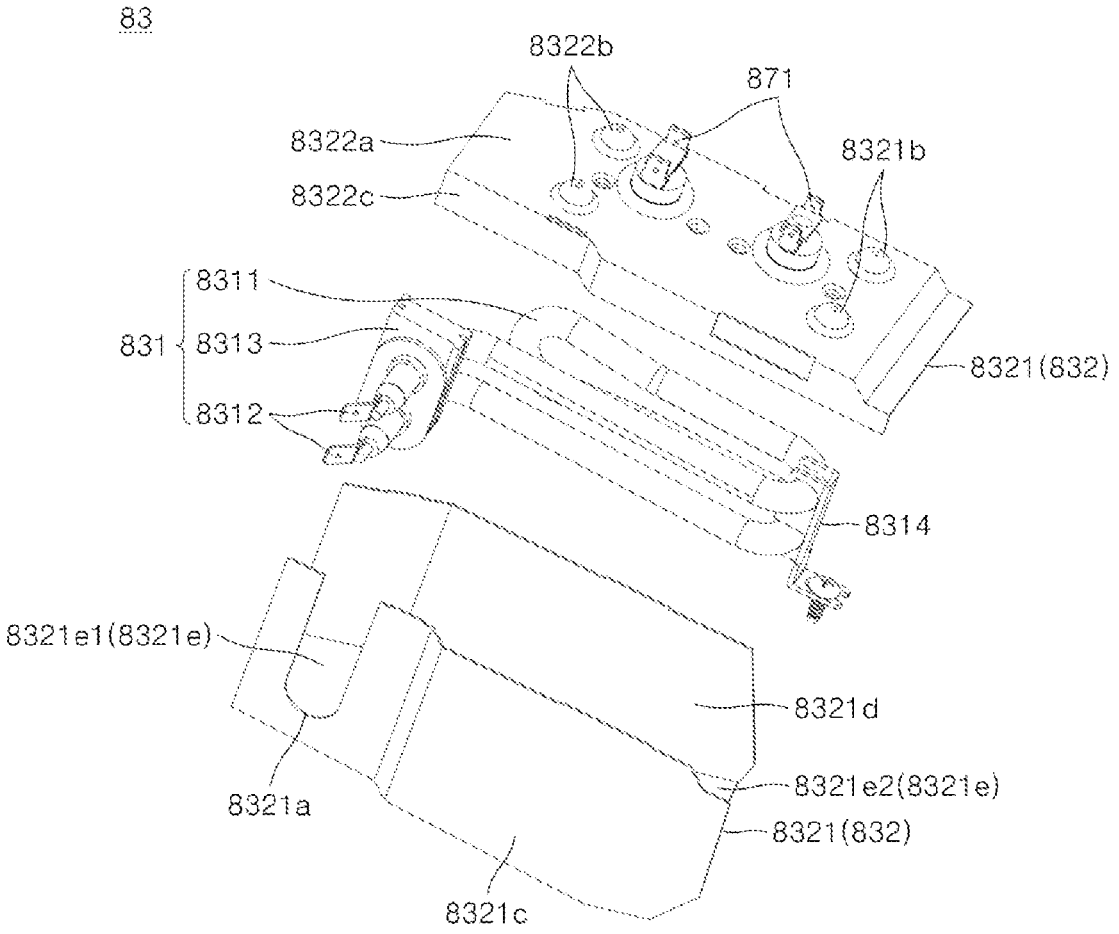
FIG. 13 is an exploded perspective view of the heater as shown in FIG. 12.

FIG. 13 shows an example in which the heater body 8311 extends in a U-shape, that is, is bent twice by 90 degrees to form two rows. The present disclosure is not limited thereto. However, following description will be based on a configuration in which the heater body 8311 extends into two rows.

The heater body 8311 of the regeneration heater 831 may extend between the inlet IN1 formed at one end, i.e., the front end of the heater receiving portion 8411 of the main housing 841 and an outlet OUT1 formed at the other end, i.e., the rear end of the heater receiving portion 8411 thereof.

In this regard, the heater body 8311 may be disposed in the heater receiving portion 8411 such that a longitudinal direction thereof is parallel to a longitudinal direction of the heater receiving space S1 and the heater housing 832.

Thus, the heat exchange performance and heat exchange efficiency of the heater body 8311 may be improved compared to a case where the longitudinal direction of the heater body 8311 intersects the longitudinal direction of the heater receiving space S1.

Further, the heater body 8311 may be closer to the outlet OUT1 formed at the rear end of the heater receiving portion 8411 than to the inlet IN1 formed at the front end of the heater receiving portion 8411, and thus may be disposed in the heater receiving portion 8411 of the housing 841.

That is, a spacing between the front end of the heater body 8311 and the inlet IN1 of the heater receiving portion 8411 may be larger than a spacing between the rear end of the heater body 8311 and the outlet OUT1 of the heater receiving portion 8411.

Thus, the heater body 8311 may be disposed at a position spaced as far away from the blower 82 as possible. Thus, a possibility of damage to the blow fan and the blower motor of the blower 82 due to radiant heat from the heater body 8311 may be minimized.

The heater body 8311 may extend such that one end and the other end thereof extend through the front surface of the heater housing 832 and the front surface of the heater receiving portion 8411 of the main housing 841.

Moreover, a pair of terminals 8312 to receive power may be formed respectively at one end and the other end of the heater body 8311.

As shown, the pair of terminals 8312 may be fixedly installed onto the heater receiving portion 8411 of the main housing 841 via a terminal fixing portion 8313.

In this regard, a front surface of the heater receiving portion 8411 may have a fixing slot 8411*c*1 defined therein so that the terminal fixing portion 8313 may be fitted thereto in a sliding manner.

A slit-shaped groove extending in a sliding direction, that is, an up-down direction (U-D direction) may be formed on each of both opposing side surfaces of the terminal fixing portion 8313. While the terminal fixing portion 8313 slides upwardly, an edge of the fixing slot 8411*c*1 may be inserted into the slit-shaped groove and fitted thereto.

In this way, a front end of the heater body 8311 may be fixed to and supported on the terminal fixing portion 8313.

A rear end of the heater body 8311 may be fixed and supported to a single heater racket 8314, as shown in FIG. 13. That is, the rear end of the heater body 8311 may be supported on an air passage while being separated from the heater housing 832 and the heater receiving portion 8411 of the main housing 841 via the tub racket 8314.

The heater tub racket 8314 may be made of a metal material in consideration of a function of the heater body 8311 which generates high temperature heat, and may be preferably made of a metal plate that is resistant to high temperature and moisture. For example, the heater tub racket 8314 may be manufactured by pressing a plate made of a stainless steel-based material.

For example, the tub racket 8314 may be manufactured to have an L-shape as shown in FIG. 13.

As shown in the illustrated embodiment, a vertical extension extending in the vertical direction (U-D direction) of the L shape structure may have two heater holders forcibly coupled to an outer surface of the heater body 8311 in a corresponding manner to the two rows of the heater body 8311 to effectively support the heater body 8311 extending in the two rows.

The heater holder may include a pair of heater holders which may be spaced apart from each other in the vertical direction and may be formed at the vertical extension in a corresponding manner to the two rows of the heater body 8311 which are spaced apart from each other along the vertical direction (U-D direction). Each heater holder may be constructed to have a C-shape corresponding to a shape of the tube-shaped heater body 8311.

Each heater holder may be forcibly coupled to the outer surface of the heater body 8311 in a plastically deformed manner when being coupled to the heater body 8311. Each heater holder may be forcibly coupled to the heater body 8311 and modularized therewith before being fixed to the bottom surface 8412*a* of the moisture absorbent receiving portion 8412 constituting the main housing 841.

A horizontal extension extending approximately along a left-right direction (Le-Ri direction) of the L-shape structure may be formed integrally with a lower end of the vertical extension.

The horizontal extension may directly contact the bottom surface 8412*a* of the moisture absorbent receiving portion 8412 of the main housing 841 and may serve to support the heater body 8311 and the vertical extension. The horizontal extension may be constructed to be fixed to the bottom surface 8412*a* of the moisture absorbent receiving portion 8412 via fastening means such as a screw bolt.

In one example, the heater housing 832 may be formed in a hollow form with an empty inner space to define an air passage in which the heater body 8311 is disposed. The air passage defined in the heater housing 832 together with an air introduction space S2 formed in a lower portion of the moisture absorbent receiving portion 8412 may constitute a first flow channel.

As described above, the heater body 8311 may be disposed in an inner space of the heater housing 832 so that a longitudinal direction thereof is parallel to the flow direction of the air flow F. Accordingly, like the heater body 8311, the heater housing 832 may be disposed in the heater receiving space S1 of the heater receiving portion 8411 of the main housing 841 so that a longitudinal direction thereof is parallel to the flow direction of the air flow F.

In this regard, in a corresponding manner to a shape of the heater receiving space S1, the heater housing 832 may extend linearly toward the air introduction space S2 along the longitudinal direction of the heater receiving portion 8411.

However, a length of the heater housing 832 may be greater than a length of the heater body 8311 so as to accommodate an entirety of the heater body 8311 therein.

In this regard, each of the front end of the heater housing 832 corresponding to a upstream side and the rear end thereof corresponding to a downstream side in the flow direction of the air flow F may be entirely opened so that the air may flow therethrough.

In this way, in order that each of the front end and the rear end may have the open air passage defined therein in an easy manner, the heater housing 832 may be divided into a lower housing 8321 and an upper housing 8322 arranged in the up-down direction (U-D) direction.

However, the present disclosure is not limited thereto. Hereinafter, as shown in FIG. 13, the description will be based on an embodiment in which the heater housing 832 is divided into the lower housing 8321 and the upper housing 8322 arranged in the up-down direction (U-D) direction.

The lower housing 8321 which constitutes a divided lower portion of the heater housing 832 constitutes a front surface, a rear surface, and a lower surface of the heater housing 832 in the illustrated state.

A passage slot 8321*a* may be formed in a U shape in a front surface 8321*c* of the lower housing 8321 so that the terminal 8312 of the heater body 8311 as described above may pass therethrough in a frontward direction.

A lower surface 8321*e* of the lower housing 8321 which constitutes a lower end surface of the inner air passage may approximately parallel to a bottom surface of the heater receiving portion 8411 of the main housing 841 which will be described later. As described later, the bottom face of the heater receiving portion 8411 may extend parallel to a longitudinal direction of the heater receiving portion 8411. Thus, similarly, the lower surface 8321*e* of the lower housing 8321 may extend parallel to the longitudinal direction of the heater receiving portion 8411.

In this regard, a front edge of the lower surface 8321*e* of the lower housing 8321 may extend toward a lower end of the inlet IN1 of the heater receiving portion 8411, while a rear edge of the lower surface 8321*e* of the lower housing 8321 may extend toward the outlet OUT1 of the heater receiving portion 8411.

In this regard, the rear edge of the lower surface 8321*e* of the lower housing 8321 may extend to a position beyond a front end of the bottom surface of the moisture absorbent receiving portion 8412.

Therefore, the lower surface 8321*e* of the lower housing 8321 may have a bent shape corresponding to a shape of a corner at which the rear end of the bottom surface of the heater receiving portion 8411 and the front end of the bottom surface of the moisture absorbent receiving portion 8412 meet each other.

More specifically, the lower surface 8321*e* of the lower housing 8321 may be configured to include a first surface 8321*e*1 extending linearly from the front edge to the lower end edge thereof so as to define a first crossing angle with respect to the bottom surface of the moisture absorbent receiving portion 8412, and a second surface 8321*e*2 that is bent from the first surface 8321*e*1 and extends parallel to the bottom surface of the moisture absorbent receiving portion 8412.

Therefore, an extension direction of a bottom surface of the first flow channel formed in an inner space of the heater housing 832 may be diverted at a position at which the second surface 8321*e*2 of the lower surface 8321*e* of the lower housing 8321 is bent from the first surface 8321*e*1.

In one example, the lower housing 8321 provides an air passage with a flow path area larger than a cross-sectional area of the inlet IN1 of the heater receiving portion 8411.

To this end, as shown in FIG. 13, the front end of the lower housing 8321 may include an expansion section whose a cross-sectional area gradually increases in a front-rear direction while extending along the flow direction of the air flow F.

Due to the expansion section, the flow rate of the air flow F may be reduced while the air flow F flows through the inlet IN1 of the heater receiving portion 8411, such that the heat exchange efficiency between the heater body 8311 and the air flow F may be improved.

In one example, the upper housing 8322 is coupled to the open upper surface of the lower housing 8321, and serves to define a top surface of the inner air passage by closing the upper surface of the lower housing 8321.

To this end, an upper surface 8322*a* of the upper housing 8322 may be formed to have a corresponding size to a size of the open upper surface of the lower housing 8321. Moreover, the upper surface 8322*a* of the upper housing 8322 may be approximately parallel to an upper surface 8411*a* of the heater receiving portion 8411 of the main housing 841, which will be described later.

A front edge of the upper surface 8322*a* of the upper housing 8322 may extend toward an upper end of the inlet IN1 of the heater receiving portion 8411, while a rear edge of the upper surface 8322*a* of the upper housing 8322 may extend toward the outlet OUT1 of the heater receiving portion 8411.

In this regard, the rear edge of the upper surface 8322*a* of the upper housing 8322 may extend to an upper end of the outlet OUT1 of the heater receiving portion 8411.

Moreover, like the lower housing 8321, the upper surface 8322*a* of the upper housing 8322 may extend linearly from the front edge to the lower end edge thereof so as to define the first crossing angle relative to the bottom surface of the moisture absorbent receiving portion 8412.

Accordingly, a top surface of the first flow channel defined in an inner space of the heater housing 832 may extend linearly to the outlet OUT1 of the heater receiving portion 8411.

Moreover, a coupling surface 8322*c* bent downwardly may be formed at each of the front edge and the rear edge of the upper surface of the upper housing 8322.

When the upper housing 8322 and the lower housing 8321 are coupled to each other, these coupling surfaces 8322*c* may be in surface contact with a front surface 8321*c* and a rear surface 8321*d* of the lower housing 8321, respectively.

Thus, coupling and connection strength between the lower housing 8321 and the upper housing 8322 may be improved.

In one example, as shown in FIG. 13, a thermostat 871 constituting a temperature sensing unit 87 may be disposed on the upper surface 8322*a* of the upper housing 8322. The thermostat 871 may detect whether the heater body 8311 is overheated.

For example, the thermostat 871 may be provided as a pair of thermostats, and the pair of thermostats 871 may be arranged in a longitudinal direction of the heater body 8311 so as to effectively detect local overheating of the heater body 8311.

Figure 10:
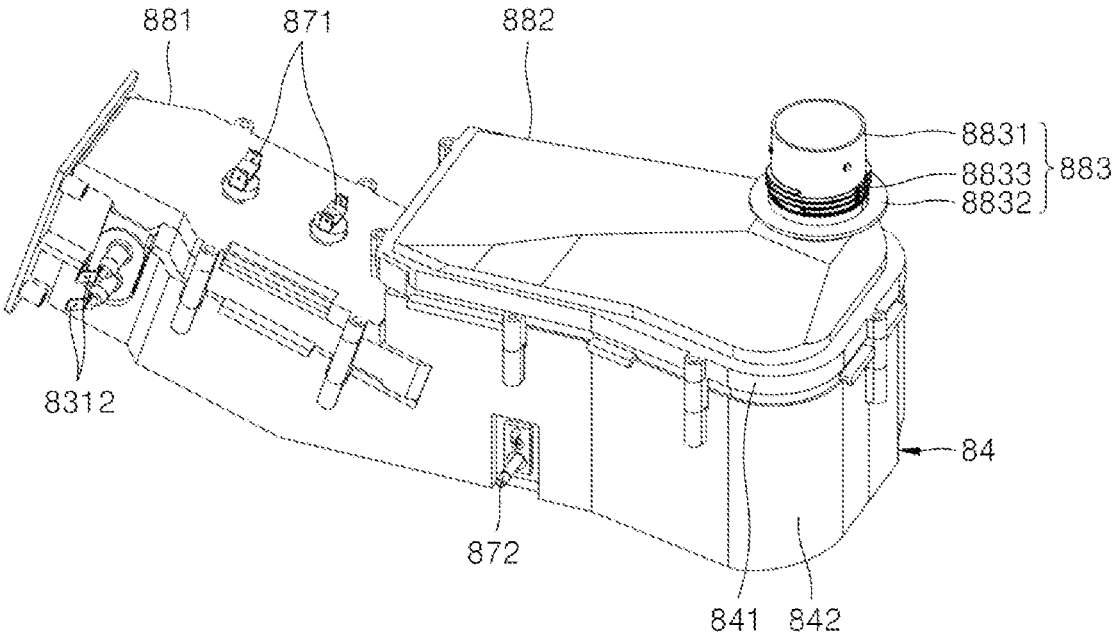
FIG. 10 and FIG. 11 are front perspective views showing a combined state of a heater, a housing, and a cover of the sorption drying device as shown in FIG. 7.
Figure 11:
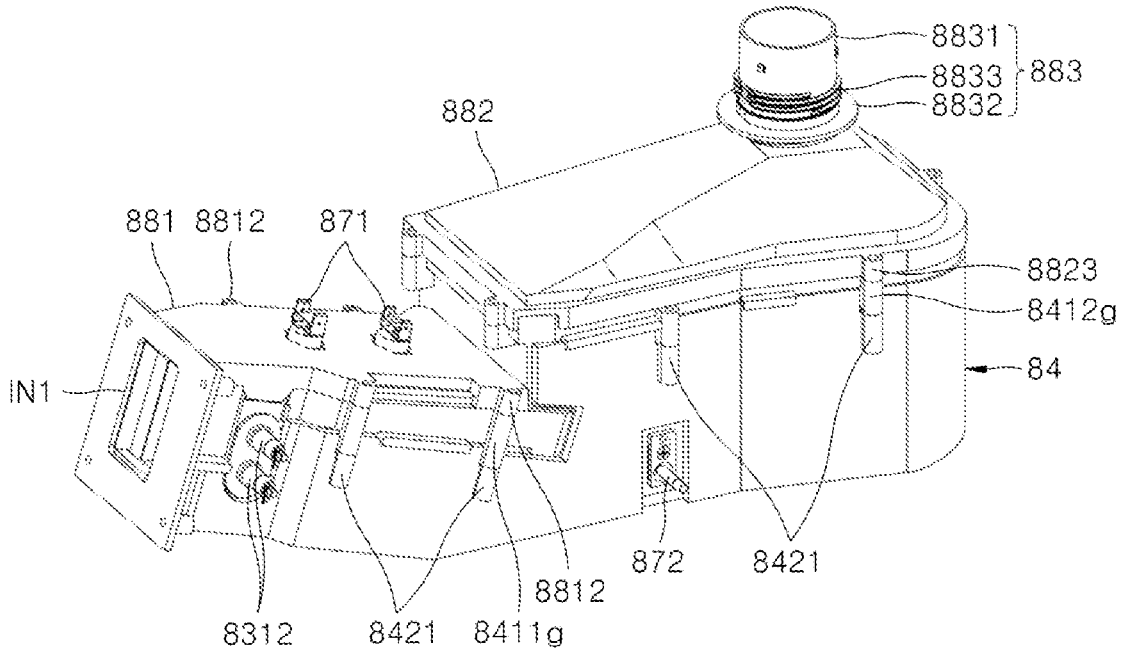

In one example, the temperature sensing unit 87 may further include a thermistor 872 that detects a temperature of the air flow F. Unlike the thermostat 871, the thermistor 872 serves to detect the temperature of the air flow F having passed through the heater body 8311. To this end, as shown in FIG. 10 and FIG. 11, in order to minimize the influence of the radiant heat from the heater body 8311, the thermistor 872 may extend through the front surface of the moisture absorbent receiving portion 8412 and a front surface of an auxiliary housing 842 which are located downstream of the heater body 8311 and the air introduction space S2, which will be described later. In this way, the thermistor 872 may extend into the inner space of the moisture absorbent receiving portion 8412 positioned between the heater body 8311 and the moisture absorbent 85 in the flow direction of the air flow so that the thermistor 872 may detect the temperature of the air flow F having passed through the heater body 8311. The thermistor 872 may identify whether the air flow F of an appropriate temperature is being supplied to the moisture absorbent 85 during an operation of the sorption drying device 80.

An output signal of the temperature sensing unit 87 may be transmitted to a controller 100 as described later, and the controller 100 may receive the output signal of the temperature sensing unit 87 and may determine whether the heater body 8311 is overheated and the temperature of the air flow F based on the output signal. When the overheating occurs, the controller may stop the operation of the heater body 8311 by cutting off the power supply to the heater body 8311.

In one example, a plurality of second bead forming portions 8322*b* that is convex in an upward direction may be formed on the upper surface 8322*a* of the upper housing 8322.

Due to the second bead forming portion 8321*b*, an isolation space may be formed between the first cover 881 disposed on top of the upper housing 8322 and the upper housing 8322 by a predefined spacing.

This isolation space may act as a thermally insulating air layer for the upper housing 8322, in a similar manner to the isolation space for the lower housing 8321 as described above.

In one example, with considering the fact that the heater body 8311 which generates high temperature heat is disposed in the housing composed of the lower housing 8321 and the upper housing 8322, each of the lower housing 8321 and the upper housing 8322 may be made of a metal plate resistant to high temperature heat and moisture. For example, each of the lower housing 8321 and the upper housing 8322 may be formed by pressing a plate made of a stainless steel-based material and having an approximately uniform thickness.

The moisture absorbent 85 absorbs moisture contained in the flow of air discharged from the tub 20 and inhaled by the device 80 when the sorption drying device 80 operates in the moisture-absorption mode. When the sorption drying device 80 operates in the moisture absorbent drying mode, the moisture absorbent 85 discharges the absorbed moisture into the air flow F.

In other words, the moisture absorbent 85 may be made of a reversibly dehydratable material so as to absorb the moisture or discharge the absorbed moisture depending on an operating temperature range.

The reversibly dehydratable material may include any one of aluminum oxide, silicon oxide, silica gel, alumina silica, or zeolite, or may be a composition having a combination of two or more selected therefrom.

In an example, the moisture absorbent 85 made of an alumina silica-based material including aluminum oxide and silicon oxide may be applied to the sorption drying device 80 according to the present disclosure. The present disclosure is not limited thereto. However, following descriptions will be based on an example in which the alumina silica-based moisture absorbent 85 is employed.

In this way, the moisture absorbent 85 made of the alumina silica-based material may be provided in a form of particles with a predefined particle size so that a contact area with the air flow F may be secured as much as possible. Moreover, compared to the moisture absorbent made of pure aluminum oxide or silicon oxide, a moisture-absorption action of the moisture absorbent 85 made of the alumina silica-based material may be effective at a lower temperature range, and regeneration action may be effective at a lower temperature range.

However, while the air flow F may flow through a gap between the plurality of moisture absorbents 85 provided in the form of particles, the air flow F may contact the moisture absorbents 85 such that the moisture contained therein is absorbed into the moisture absorbents 85 or the air flow absorbs the moisture discharged from the moisture absorbents 85.

Therefore, the moisture absorbent 85 cannot help but act as flow resistance to the air flow F. The particle size of the moisture absorbent 85 may be selected such that a pore may be effectively formed between the particles to minimize such flow resistance, and optimal moisture-absorption efficiency may be secured.

For this purpose, the moisture absorbent 85 may have the particle size in a range of 2 mm to 6 mm.

In one example, the moisture absorbent 85 is disposed downstream of the blower 82 and the heating unit 83 in the flow direction of the air flow F.

More specifically, the moisture absorbent 85 may be accommodated in the moisture absorbent receiving space S3 of the main housing 841 positioned downstream of the blower 82 and the heater 83.

The moisture absorbent receiving space S3 may be defined in the moisture absorbent receiving portion 8412 of the main housing 841 and may be defined by a pair of moisture absorbent holders 86 disposed to be spaced apart from each other along the vertical direction.

Figure 12:
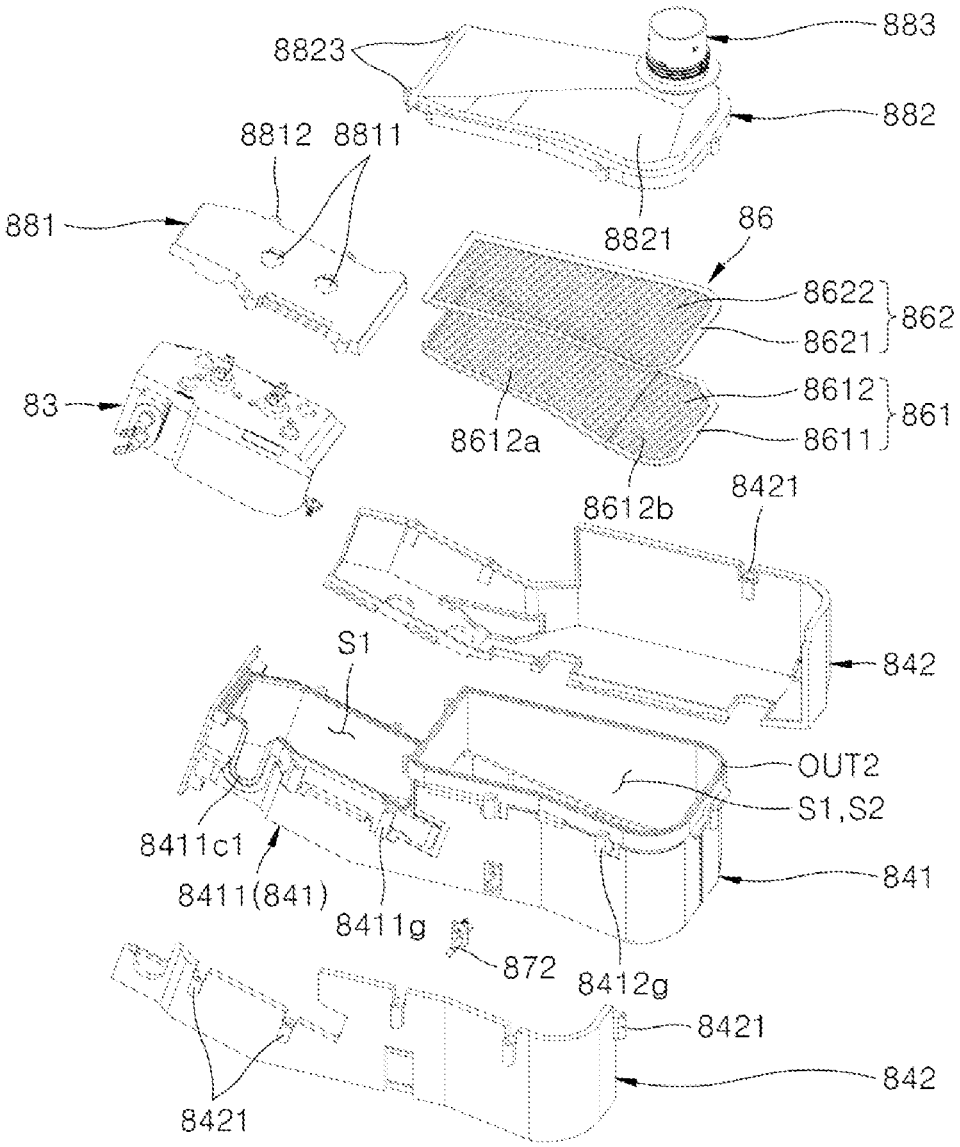
FIG. 12 is an exploded perspective view of FIG. 10 and FIG. 11.

As shown in FIG. 12, in one example, the pair of moisture absorbent holders 86 may be configured to include a first moisture absorbent holder 861 defining the lower end surface of the moisture absorbent receiving space S3 and dividing the inner space of the moisture absorbent receiving portion into the moisture absorbent receiving space S3 and the air introduction space S2, and a second moisture absorbent holder 862 defining a top surface of the moisture absorbent receiving space S3.

The first moisture absorbent holder 861 and the second moisture absorbent holder 862 may be formed in a plate shape so as to define the top surface and the lower end surface of the moisture absorbent receiving space S3, respectively.

More specifically, the first moisture absorbent holder 861 may be configured to include an outer edge 8611 to maintain overall strength thereof, and a mesh 8612 that is formed in an inner space defined by the outer edge 8611 and allows air to flow therethrough.

Likewise, the second moisture absorbent holder 862 may be configured to include an outer edge 8621 for maintaining overall strength thereof, and a mesh 8622 formed in an inner space defined by the outer edge 8621 and allows air to flow therethrough.

Thus, between the mesh 8612 of the first moisture absorbent holder 861 and the mesh 8622 of the second moisture absorbent holder 862, a second flow channel through which the air flow F may pass may be formed.

In this regard, in order to prevent the moisture absorbent 85 from leaving out of the moisture absorbent receiving space S3, a grid size of each of the mesh 8612 of the first moisture absorbent holder 861 and the mesh 8622 of the second moisture absorbent 85 may be smaller than the particle size of the moisture absorbent 85.

In one example, the mesh 8622 of the second moisture absorbent holder 862 may extend approximately parallel to the bottom surface of the moisture absorbent receiving portion 8412. The mesh 8612 of the first moisture absorbent holder 861 may extend so as to define a predefined crossing angle with respect to the bottom surface of the moisture absorbent receiving portion 8412.

In more detail, the mesh 8612 of the first moisture absorbent holder 861 may include a first holding surface 8412*a* defining a second crossing angle relative to the bottom surface of the moisture absorbent receiving portion 8412, and a second holding surface 8612*b* defining a third crossing angle relative to the bottom surface of the moisture absorbent receiving portion 8412.

In this regard, the third crossing angle may be smaller than the second crossing angle.

That is, the mesh 8612 of the first moisture absorbent holder 861 may be constructed to have double inclined surfaces including the first holding surface 8612*a* and the second holding surface 8612*b*.

Therefore, due to the shape of the mesh 8612 of the first moisture absorbent holder 861, the mesh 8612 of the first moisture absorbent holder 861 may extend in an inclined manner such that a vertical distance therefrom to the bottom surface of the moisture absorbent receiving portion 8412 gradually decreases as the mesh 8612 extends in a direction away from the heater receiving portion 8411.

Due to the shapes and the arrangement of the first moisture absorbent holder 861 and the second moisture absorbent holder 862, a vertical dimension of the second flow channel defined in the moisture absorbent receiving space S3 gradually increases as the channel C2 extends away from the heater receiving portion 8411. Moreover, a vertical dimension of the air introduction space S2 defined under the first moisture absorbent holder 861 gradually decreases as the space S2 extends away from the heater receiving portion 8411.

In one example, the housing 84 of the sorption drying device 80 accommodates therein the above-described heating unit 83 and moisture absorbent 85, and may define therein the first flow channel of the air flow F having passed through the heater body 8311 and the second flow channel of the air flow F having passed through the moisture absorbent 85.

In one example, as shown in FIGS. 10 to 12, the housing 84 may be configured to include the main housing 841 having the heater receiving space S1 in which the heating unit 83 is accommodated and the moisture absorbent receiving space S3 in which the moisture absorbent 85 is accommodated defined therein, and the auxiliary housing 842 coupled to an outer peripheral surface of the main housing 841.

First, the main housing 841 may include the heater receiving portion 8411 in which the heater receiving space S1 is formed, and the moisture absorbent receiving portion 8412 in which the moisture absorbent receiving space S3 is formed.

As shown, based on a state in which the device 80 is disposed on the base 90, the upper surface of the heater receiving portion 8411 may be entirely open and the heater receiving portion 8411 may have a hollow box shape having an overall hexahedral shape.

The heater housing 832 and the heater body 8311 may be inserted through the open upper surface of the heater receiving portion 8411.

The open upper surface of the heater receiving portion 8411 may be closed by coupling the first cover 881 which will be described later thereto after the placement and the assembly of the heating unit 83 has been completed. For this purpose, a fastening boss 8411*g* may be integrally formed with the front surface 8411*c* and the rear surface 8411*d* of the heater receiving portion 8411 as a position corresponding to a fastening boss 8812 of the first cover 881.

The heater receiving space S1 having a shape corresponding to the shape of the heater housing 832 may be formed in an inner space of the hollow heater receiving portion 8411.

In one example, based on the state in which the device 80 is disposed on the base 90, the moisture absorbent receiving portion 8412 of the main housing 841 may have an entirely open upper surface, and may have a generally hexahedral hollow box.

The open upper surface of the moisture absorbent receiving portion 8412 may function as the outlet OUT2 through which the air having passed through the moisture absorbent 85 is discharged out.

The open upper surface of the moisture absorbent receiving portion 8412 may be closed by combining a second cover 882 which will be described later thereto after the placement of the moisture absorbent holder 86 and the moisture absorbent 85 into the inner space of the moisture absorbent receiving portion 8412 has been completed.

For this purpose, a fastening boss 8412*g* may be integrally formed with each of a front surface, a rear surface, a right surface and a left surface of an outer peripheral surface of the moisture absorbent receiving portion 8412 as a position corresponding to each of fastening bosses 8823 of the second cover 882.

In one example, the auxiliary housing 842 may be coupled to the main housing 841 so as to at least partially surround the outer surface of the main housing 841, and serves to thermally insulate the inner space of the main housing 841 from the outside.

As shown, the auxiliary housing 842 may be disposed to surround an outer peripheral surface and an outer bottom surface of the main housing 841.

In this regard, a gap may be formed at least locally between an inner surface of the auxiliary housing 842 and the outer peripheral surface and the outer bottom surface of the main housing 841.

Due to this gap, a thermally insulating air layer may be formed between the auxiliary housing 842 and the main housing 841 in a similar manner to the thermally insulating air layer formed between the heater housing 832 and the heater receiving portion 8411 of the main housing 841 as described above.

Therefore, an amount of heat transfer from the inner space of the main housing 841 to the outside may be minimized. An internal temperature of the main housing 841 may be maintained in a temperature environment suitable for operation in the moisture-absorption mode or the moisture absorbent regeneration mode. Accordingly, power consumption may be minimized and the drying time of the washing target and the regeneration time of the moisture absorbent may be shortened.

The auxiliary housing 842 may be provided as divided structures arranged along the front and rear direction, as shown in FIG. 12 in consideration of case of manufacturing and assembly.

In one example, as described above, the open upper surface of the heater receiving portion 8411 of the main housing 841 and the open upper surface of the moisture absorbent receiving portion 8412 may be closed by the cover 88.

As shown by way of example, in consideration of the shape of the main housing 841, the cover 88 may be configured to include a first cover 881 coupled to the heater receiving portion 8411 and a second cover 882 coupled to the moisture absorbent receiving portion 8412.

The first cover 881 coupled to the heater receiving portion 8411 may be provided in a plate shape corresponding to the shape of the upper housing 8322 of the heater housing 832.

A pair of through holes 8811 may be formed in the first cover 881 to allow the aforementioned thermostat 871 to pass therethrough.

Moreover, a plurality of fastening bosses 8812 for fastening the main housing 841 and the auxiliary housing 842 to each other may be integrally formed with the outer edge of the first cover 881. A fastening means such as a screw bolt may extend through the fastening boss 8812, and may be screw-coupled to the fastening boss 8411*g* provided at the heater receiving portion 8411 of the main housing 841 or the fastening boss 8421 provided at the auxiliary housing 842.

In a similar manner to the thermally insulating air layer defined between the lower housing 8321 of the heater housing 832 and the heater receiving portion 8411 of the main housing 841, a thermally insulating air layer may be formed between the first cover 881 and the upper housing 8322.

In one example, unlike the first cover 881, the second cover 882 coupled to the moisture absorbent receiving portion 8412 may be formed to have a three-dimensional shape similar to an inverted funnel shape.

That is, the inner surface of the second cover 882 may be constructed to have an inverted funnel shape that is convex upwardly so that the air that has passed through the moisture absorbent 85 and the second moisture absorbent holder 862 as described above may converge.

Therefore, as the second cover 882 is provided with a converging surface 8821 that is convex upwardly, a predefined spacing may be formed between the second moisture absorbent holder 862 which defines the top surface of the moisture absorbent receiving space S3, and the converging surface 8821 of the second cover 882. The spacing S4 may act as a discharge flow path of the air having passed through the moisture absorbent 85. Because the discharge flow path continuously communicates with the second flow channel formed between the pair of moisture absorbent holders 86, the discharge flow path may be referred to as a third flow channel.

An upper end of the inner converging surface 8821 of the second cover 882 may have an outlet defined therein through which the air having passed through the third flow channel as the discharge flow path is discharged.

As will be described later, a lower end of the connection duct 883 which guides the air flow F toward the lower surface 25 of the tub 20 may be integrally connected to the outlet.

Moreover, like the first cover 881, a plurality of fastening bosses 8823 for fastening the main housing 841 and the auxiliary housing 842 to each other may be formed integrally with the outer edge of the second cover 882. The fastening means such as the screw bolt may extend through the fastening boss 8823, and may be screw-coupled to the fastening boss 8412*g* provided at the moisture absorbent receiving portion 8412 of the main housing 841 or the fastening boss 8421 provided at the auxiliary housing 842.

In one example, the sorption drying device 80 may further include the connection duct 883 which is connected to the outlet passing through the upper surface of the second cover 882 and which has an air passage defined therein.

As described above, the heater 83, the blower 82, and the moisture absorbent 85 are disposed under the lower surface 25 of the tub 20. The connection duct 883 serves to guide the air flow F discharged from the spacing formed under the second cover 882 toward the air supply hole 254 formed in the lower surface 25 of the tub 20.

As shown in the illustrated embodiment, a duct body 8831 of the connection duct 883 may be constructed to have a shape to connect the air supply hole 254 of the tub 20 and the outlet of the heater housing 832 to each other so as to guide the air flow F.

For example, as shown in FIG. 10 and FIG. 11, the duct body 8831 of the connection duct 883 may have a cylinder shape having a lower end in fluid communication with the outlet of the second cover 882, and an upper end extending in an upward direction (U-direction) and through the air supply hole 254.

In one example, as a means to improve fastening efficiency and prevent water leakage, a ring-shaped flange surface 8832 and a male screw member 8833 may be integrally formed with an outer peripheral surface of the duct body 8831.

The upper end of the duct body 8831 may extend upwardly (in the U-direction) through the lower surface 25 of the tub 20. The upper end of the duct body 8831 and the male screw member 8833 may at least partially extend through the lower surface 25 of the tub 20 and protrude toward the inner space of the tub 20.

A fastening nut may be coupled to the male screw member 8833 extending through the inner space of the tub 20.

In fixing and fastening the duct body 8831, the upper end 8511 of the duct body 8831 may be fixed in an exposed state to the inner space of the tub 20 by screw-coupling the fastening nut to the male screw member 8833 in the inner space of the tub 20.

That is, in a state in which the fastening nut is in close contact with an upper side of the lower surface 25 of the tub 20, and the ring-shaped flange surface 8832 is in close contact with a lower side of the lower surface 25 of the tub 20, the flange surface 8832 may be pulled toward the lower surface 25 of the tub 20 under a coupling force of the fastening nut. Thus, the adhesion between the flange surface 8832 and the lower surface 25 of the tub 20 may be increased. Therefore, the possibility at which the washing water leaks to the outer peripheral surface of the duct body 8831 may be significantly reduced.

As a means to increase the effect of preventing the leakage of the washing water, an airtight ring made of an elastic material may be additionally provided between the flange surface 8832 and the lower surface 25 of the tub 20.

In this way, when the upper end 8511 of the duct body 8831 is fixed to the tub 20 via the fastening nut, the left end of the heater housing 832 may be prevented from moving up and down (U-D direction) by the duct body 8831 and thus may be in a fixed state.

Thus, a support structure for an upper side of the sorption drying device 80 may be achieved without having additional fastening means.

The support structure for a lower side of the sorption drying device 80 may be achieved through a plurality of legs that protrude downwards from the bottom surface of the moisture absorbent receiving portion 8412 of the main housing 841.

In one example, the discharge guide 89 that changes the discharge direction of the air flow F supplied through the connection duct 883 may be coupled to the upper end of the duct body 8831.

Through the discharge guide 89, a portion of the air flow F may be directed toward the lower surface 25 of the tub 20, while a portion of the air flow F may be directed toward the upper surface 24 of the tub 20.

In one example, the sorption drying device 80 may further include the air intake duct 81 which has a front end connected to the air intake hole of the tub 20, and has a rear end connected to the blower 82, and that serves to guide the air flow F discharged from the tub 20 through the air supply hole 254 to the blower 82.

Figure 7:
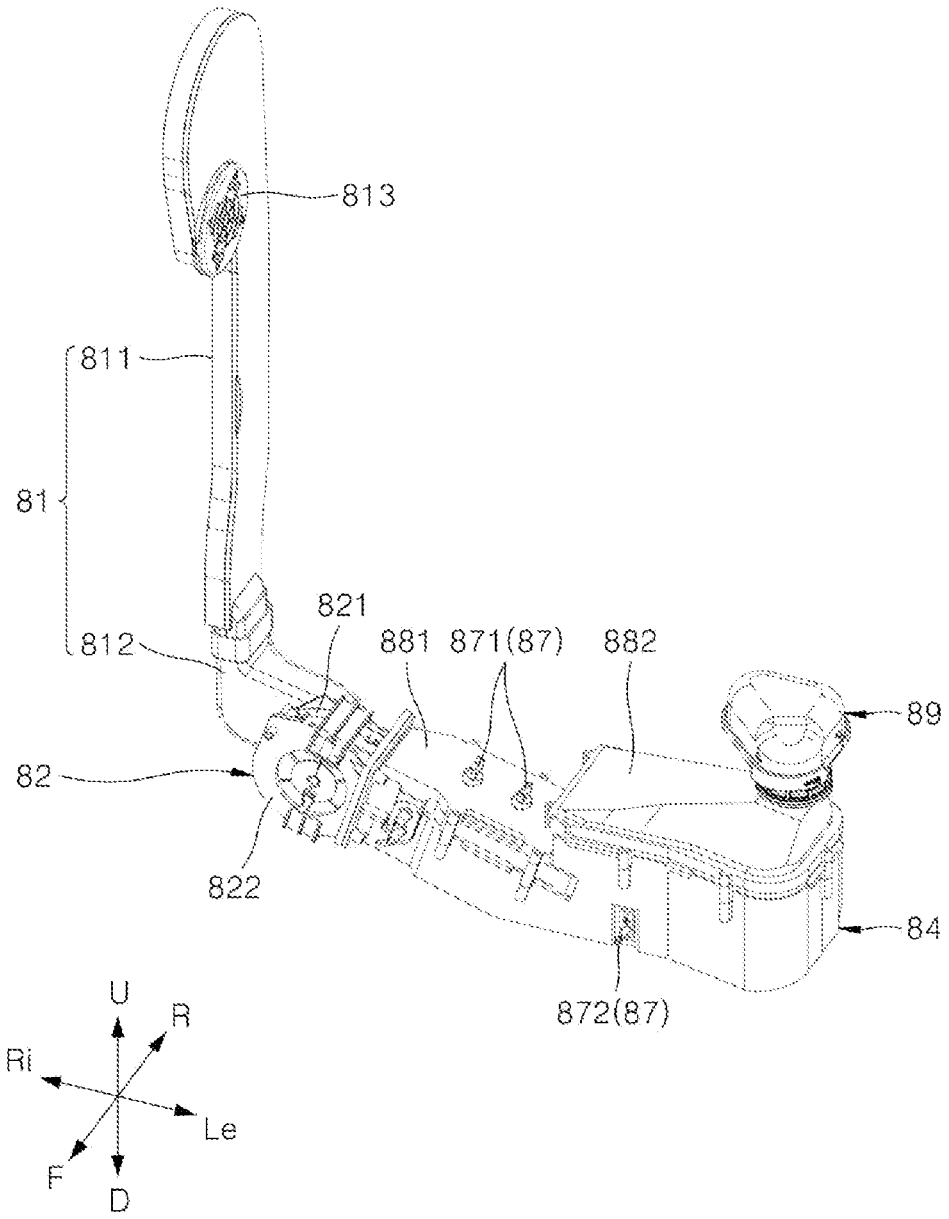
FIG. 7 is a front perspective view of a sorption drying device of a dishwasher according to an embodiment of the present disclosure.
Figure 8:
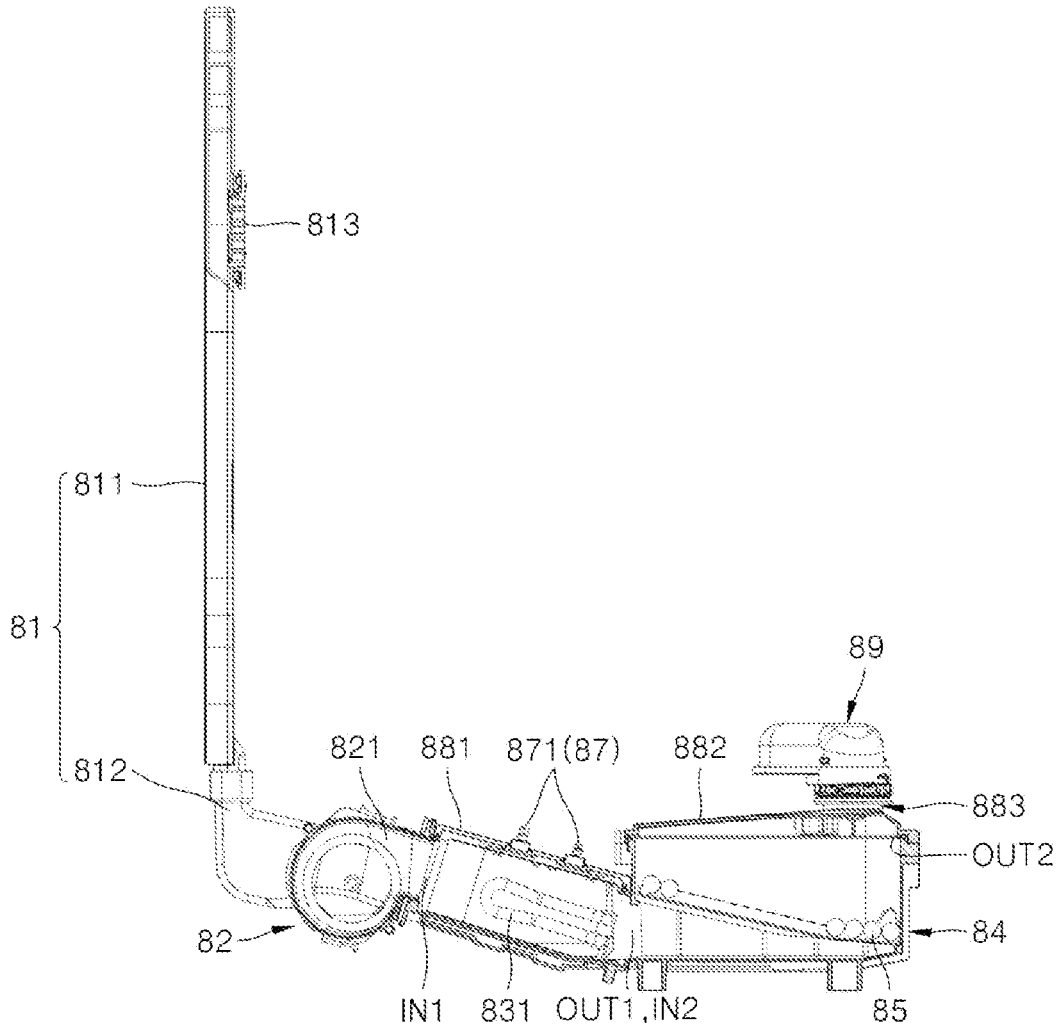
FIG. 8 is a cross-sectional view of the sorption drying device as shown in FIG. 7.

More specifically, as shown in FIGS. 7 to 9, the air intake duct 81 may be configured to include the main duct 811 extending along the vertical direction and disposed on an outside of the right side surface of the tub 20, and the auxiliary duct 812 located between the rear end of the main duct 811 and the blower 82 and under the lower surface 25 of the tub 20.

The main duct 811 may be disposed on the outside of the right side surface of the tub 20 and may be in close contact with the right side surface, and serves to guide the air flow F sucked through the air intake hole formed in the right side surface of the tub 20 to a position under the lower surface 25 of the tub 20.

To this end, as shown, the main duct 811 may be disposed so as to extend linearly as long as possible along the vertical direction between the upper end and the lower end.

The main duct 811 may be manufactured in a hollow shape so that the air passage through which the air flow F may flow is formed therein.

In order to easily implement the hollow shape and for convenience of manufacturing, as shown in FIG. 9, in one example, the main duct 811 may be divided into the first duct body 8111 and the second duct body 8112, and each of the first duct body 8111 and the second duct body 8112 may be divided into segments along a vertical plane.

The first duct body 8111 may be formed in a shape of a hollow box with an open left side surface so that an inverted U-shaped air passage may be formed therein.

An inner space of the first duct body 8111 is maintained in a hollow state. Therefore, in the inner space of the first duct body 8111, a reinforcing rib 8113 extending along the extension direction of the air passage may be integrally disposed on the right side surface and may protrude from the right side surface to the left side surface.

In an example, the reinforcing rib 8113 may be positioned to divide the internal space of the first duct body 8111 to two spaces. Therefore, the reinforcing rib 8113 may play the role of dividing the air passage in the main duct 811 into two air passages.

Moreover, the reinforcing rib 8113 extends from the upper end of the inlet 811*a* formed in the second duct body 8112 to the outlet 811*b* of the main duct 811 along the air passage. Therefore, the reinforcing rib 8113 may also serve as a barrier that minimizes flow of the washing water flowing from the inlet 811*a* and scattering toward the outlet 811*b*.

The lower end of the first duct body 8111 may be open downwardly and this opening may constitute a portion of the outlet 811*b* through which the flow of air flows.

The second duct body 8112 is coupled to the open left side surface of the first duct body 8111 and serves to close the air passage formed in the first duct body 8111.

To this end, the second duct body 8112 may be provided in a plate shape corresponding to a shape of the open left side surface of the first duct body 8111.

An inlet 811*a* having a shape and size corresponding to those of the air intake hole of the tub 20 may be formed in the second duct body 8112. As described above, the grill cap 813 may be fastened to the inlet 811*a* to minimize the inflow of the washing water and prevent the inflow of foreign substances.

The lower end of the second duct body 8112 may be opened downwardly and this opening may constitute a remaining portion of the outlet 811*b* through which the flow of air flows.

The lower end of the first duct body 8111 and the lower end of the second duct body 8112 may be connected to each other to constitute the outlet 811*b* of the main duct 811, and may be connected to the auxiliary duct 812 so as to be inserted into the inlet of the auxiliary duct 812, which will be described later. An airtight ring 814 made of an elastic material may be disposed between an outlet 811*b* of the main duct 811 and an inlet 812*a* of the auxiliary duct 812.

The auxiliary duct 812 may be disposed between the lower end of the main duct 811 and the blower 82, and serves to change the flow direction of the air flow having passed through the outlet 811*b* of the main duct 811 toward to the blower 82.

Like the main duct 811, an air passage through which the air flow F having passed through the main duct 811 may flow may be formed in an inner space of the auxiliary duct 812.

However, in order to change the flow direction of the air having passed through the main duct 811 toward the inlet of the fan housing 821 of the blower 82, an air passage extending in an L shape may be formed in an inner space of the auxiliary duct 812.

Likewise, a shape of the auxiliary duct 812 may have an L-shape corresponding to the shape of the air passage defined therein.

The inlet 812*a* through which the flow of air is introduced may be formed at one end of the L-shape, that is, at an upper end thereof, based on the state shown in the drawing. The outlet 812*b* may be formed at one end of the L-shape, that is, at a lower end thereof, based on the state shown in the drawing.

The inlet 812*a* of the auxiliary duct 812 may have a rectangular cross-section shape corresponding to a shape of the outlet 811*b* of the main duct 811. The outlet 812*b* of the auxiliary duct 812 may have a circular shape corresponding to a shape of a circular inlet disposed in the other side surface of the fan housing 821.

In one example, a bridge 8123 as a fastening means for the fan housing 821 may be provided around the outlet 812*b* of the auxiliary duct 812.

In a manner similar to the bridge 8223 of the aforementioned connecting bracket 822, one end of the bridge 8123 of the auxiliary duct 812 may be fixed to the upper side of the outlet 812*b* of the auxiliary duct 812, while the other end thereof may extend in a bar shape to one side surface of the fan housing 821.

A fastening hole through which a fastening means such as a screw bolt passes may be defined in the other end of the bridge 8123 of the auxiliary duct 812. The fastening means may pass through the fastening hole and be fixed to one side surface of the fan housing 821.

Configuration of Controller and Control Method of the Dishwasher

Hereinafter, with reference to FIG. 14, a configuration of the controller 100 that constitutes the dishwasher 1 according to an embodiment of the present disclosure will be described.

Figure 14:
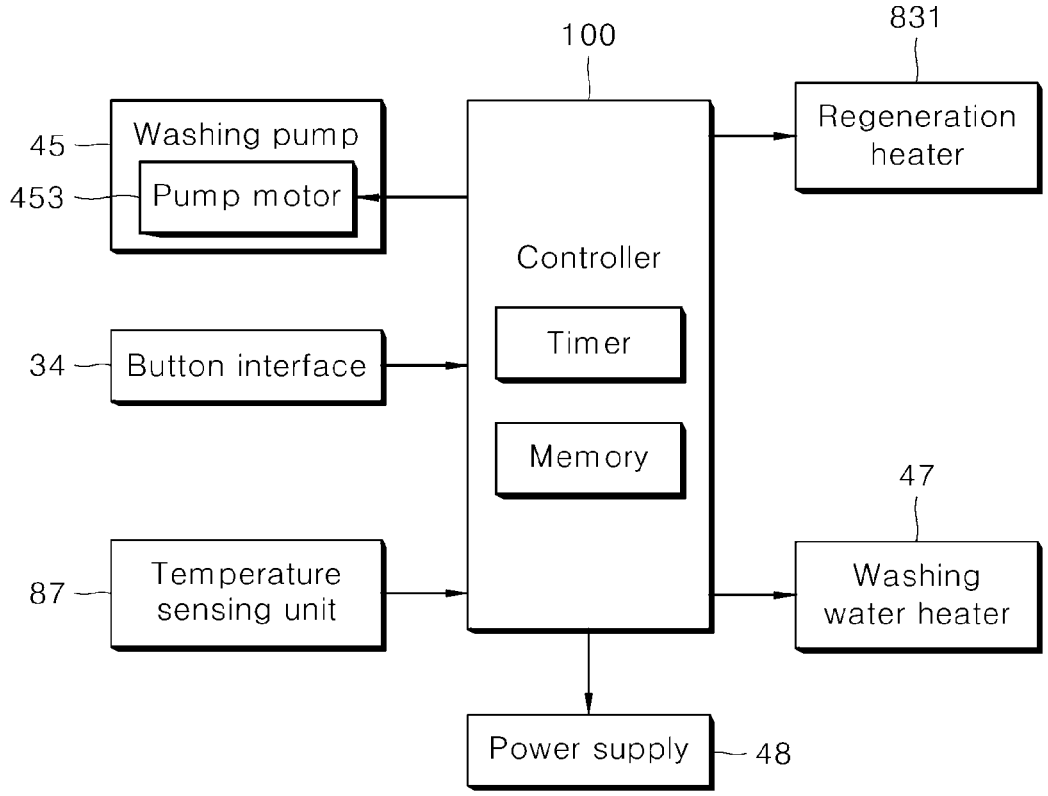
FIG. 14 is a functional block diagram schematically illustrating a configuration of a controller provided in a dishwasher according to one embodiment of the present disclosure.

As shown in FIG. 14, the dishwasher 1 according to one embodiment of the present disclosure may include the controller 100 to control a function of each component.

As known in the art, the controller 100 may be provided in various forms such as a microcontroller, a microcomputer, or a microprocessor.

First, the controller 100 may be electrically connected to a motor 453 of the washing pump 45 to pressurize and supply the washing water stored in the sump 41 to the water sprayer 60. The controller 100 may start or stop an operation of the washing pump 45 by controlling power to be supplied to the motor 453 from a power supply 48, which will be described later.

When a washing cycle S2, a rinse cycle S3, and a heating rinse cycle S4 are started, the controller 100 may start an operation of the washing pump 45 by supplying power to the motor 453 of the washing pump 45 through the power supply 48.

Moreover, the controller 100 may be electrically connected to a button interface 34 into which the user's manipulation command is input. When a power on-off manipulation input and a washing course selection manipulation input from the user are input through the button interface 34, the button interface 34 may transmit a corresponding electrical signal to the controller 100.

Upon receiving the electrical signal from the button interface 34, the controller 100 may turn on or off the power of the dishwasher 1 or control the dishwasher 1 such that an individual cycle of the dishwasher 1 is performed according to the selected washing course.

In some implementations, the user's manipulation command may be input through other input means, such as the user's wireless terminal, in addition to the button interface 34.

Moreover, the controller 100 may be electrically connected to the temperature sensor 87 for detecting the temperature of the air flow F passing through the sorption drying device 80 and whether the heater 83 is overheated.

As described above, the thermostat 871 of the temperature sensing unit 87 may be disposed to contact the heater housing 832 and may generate an output signal regarding whether the regeneration heater 831 is overheated. The thermistor 872 of the temperature sensing unit 87 may be installed to extend through the moisture absorbent receiving portion 8412 of the main housing 841 and may generate an output signal containing information about the temperature of the air flow F introduced into the moisture absorbent 85.

The controller 100 may receive the output signal of the temperature sensing unit 87 and may determine the temperature of the air flow F currently passing through the sorption drying device 80 and whether the heater 83 has been overheated based on the information included in the output signal.

Moreover, the controller 100 may be electrically connected directly or indirectly to the regeneration heater 831 which heats the air flow F to be supplied to the moisture absorbent 85 in order to dry and regenerate the moisture absorbent 85.

FIG. 14 shows an embodiment in which the regeneration heater 831 is configured to receive the power from the power supply 48 indirectly through the controller 100. However, unlike this configuration, the regeneration heater 831 may be directly electrically connected to the power supply 48, and the controller 100 may be configured to control the power supply 48 to supply the power to the regeneration heater 831. The present disclosure is not limited thereto. However, following description will be made based on the illustrated embodiment.

The controller 100 may turn on or turn off the regeneration heater 831 by controlling the power from the power supply 48 which will be described later to be supplied to the regeneration heater 831.

More specifically, in order to regenerate the moisture absorbent 85 before the drying cycle S5, the controller 100 may supply the power to the regeneration heater 831 to turn on the regeneration heater 831 during the washing cycle S2 or during the rinse cycle S3 and the heating rinse cycle S4.

As described later, the controller 100 operates the regeneration heater 831 for drying and regenerating the moisture absorbent 85 during the washing cycle S2. However, it is determined that the regenerating of the moisture absorbent 85 is incomplete, the controller 100 may supply power to the regeneration heater 831 to further operate the regeneration heater 831 during the rinse cycle S3 and the heating rinse cycle S4.

In one example, the regeneration heater 831 is configured to heat the air flow F. Thus, the regeneration heater 831 may have a lower output capacity than that of the washing water heater 47 for heating washing water. For example, the regeneration heater 831 may have a rated capacity ranging from 500 W to 600 W.

Moreover, the controller 100 may be electrically connected to the washing water heater 47 which heats the washing water to be supplied to the tub 20 during the washing cycle S2 and the heating rinse cycle S4.

FIG. 14 shows an embodiment in which the washing water heater 47 is configured to receive power from the power supply 48 indirectly through the controller 100. Alternatively, like the regeneration heater 831, the washing water heater 47 may be directly connected electrically to the power supply 48, and the controller 100 may be configured to control the power supply 48 to supply the power to the washing water heater 47. The present disclosure is not limited thereto. However, following description will be made based on the illustrated embodiment.

Unlike the regeneration heater 831, the washing water heater 47 serves to heat the washing water circulating in the tub 20. Therefore, the washing water heater 47 may be configured to have a larger output capacity than that of the regeneration heater 831.

For example, when the output capacity of the regeneration heater 831 has a rated capacity in a range of 500 W to 600 W, the output capacity of the washing water heater 47 may have a rated capacity in a range of 1100 W to 1300 W.

In one example, the washing water heater 47 may be provided as a variable capacity heater whose output varies depending on an intensity of the power supplied thereto from the power supply 48. Therefore, as described later, when the regeneration heater 831 and the washing water heater 47 operate simultaneously such that it is expected that an overload will occur in the power supply 48, the voltage supplied from power supply 48 may be adjusted to generate a lower output. For example, when the washing water heater 47 is used alone, a first voltage in a range of 110V to 130V may be supplied to the washing water heater 47 with a rated capacity in the range of 1100 W to 1300 W. If it is determined that the overload will occur in the power supply 48, a second voltage in a range of 90V to 100V which is lower than a rated voltage may be supplied thereto such that the output capacity of the washing water heater 47 may be adjusted to generate an output in the range of 700 W to 900 W.

The controller 100 may regulate the power to be supplied to each of the components of the dishwasher 1 such as the motor 453 of the washing pump 45, the regeneration heater 831, and the washing water heater 47, in response to a cycle progress of the washing course selected by the user, and thus may control an operation thereof.

An operation parameter of each of the components of the dishwasher 1 may be set in a memory which will be described later, based on the washing course that the user may select by pressing the button interface through the control panel 32 or a wireless terminal.

The operation parameters such as an operating time, a power supply amount, a power intensity, an on-off condition, etc. of each of the components such as the washing water heater 47, the regeneration heater 831, the washing pump 45, the water discharger 44, and the water supply 43 of the dishwasher 1 may be set in the memory. A collection of the operation parameters based on each washing course may be defined as a mode.

The washing course may refer to a name of an operating mode of the dishwasher 1 displayed on the display 33 of the dishwasher 1 or a screen of the wireless terminal. That is, the user may select the washing course, and the controller 100 of the dishwasher 1 may control individual components of the dishwasher 1 to sequentially execute a mode corresponding to the washing course. In other words, in accordance with the present disclosure, the washing course and the mode are named in a distinguished manner from each other for specific description, but may have similar meanings.

The washing course may include various courses such as a general course, a standard course, a strong course, a delicate course, a half course, an automatic course (a half load course, intensive washing on only some of several racks), a short course, a 1 hour course, etc.

A notation of the name of the washing course may vary slightly depending on a product. In particular, in the 1 hour course, the dishwasher operates for a time amount smaller than or equal to 1 hour, but in some cases, the dishwasher may operate for 2 hours or smaller.

That is, when the user selects the washing course, the controller 100 may determine an operation mode of the dishwasher 1 corresponding to the selected washing course. Then, the selected washing course may be executed according to preset parameters of the determined operation mode.

In one example, an additional option may be set for each washing course. The options may include setting of a drying cycle operation time, whether or not a storage mode operates after an entire cycle operation, and turning on or off of a notification.

The washing course may be broadly classified into a first course and a second course.

When the first course is selected, the controller 100 may control the operation of the components of the dishwasher 1 in a first mode corresponding to the first course. When the second course is selected, the controller 100 may control the operation of the components of the dishwasher 1 in a second mode corresponding to the second course.

In this regard, the second course may be a course with a shorter operating time than that of the first course.

The first washing course may be any washing course that requires a relatively long operating time, such as a general course, a strong course, or a delicate course. The second washing course may be any course with a relatively short operating time compared to that of the first washing course, such as a short course, a 1 hour course, a half course, or a half load course.

For example, the second washing course conducted according to the second mode may be a washing course that takes less than 1 hour of the operation time. The first washing course conducted according to the first mode may be a washing course that takes more than 1 hour of the operation time.

As described later, an operation of the dishwasher 1 may include a process in which the regeneration heater 831 and the washing water heater 47 operate simultaneously when the dishwasher operates in the second mode, and a process in which the regeneration heater 831 and the washing water heater 47 operate not simultaneously but non-simultaneously when the dishwasher operates in the first mode.

In one example, when the user selects an automatic course, an amount of contamination on the dish may be measured in a preliminary washing cycle at the start of the washing course, and a washing cycle condition may be set based on the amount of contamination.

When the amount of contamination on the dish is determined to be low such that the operation mode corresponding to an operation time of 2 hours or smaller is executed, the washing water heater 47 and the regeneration heater 831 may operate simultaneously. That is, when the automatic course is selected, the washing water heater 47 and the regeneration heater 831 may simultaneously operate, or the washing water heater 47 and the regeneration heater 831 may not simultaneously operate.

As mentioned above, the present disclosure aims to provide the dishwasher 1 that may efficiently heat the washing water and regenerate the moisture absorbent 85 even when the second washing course corresponding to a short operating time is selected.

For example, a minimum regenerating time for regenerating the moisture absorbent 85 may be 30 minutes. In this case, when the second washing course corresponding to a total operating time of about 1 hour is selected, an operation time of the washing cycle S2 is smaller than a sum of a regenerating time of the moisture absorbent 85 and a heating time of the washing water.

For this purpose, when the second washing course corresponding to a total operating time of about 1 hour is selected, the controller 100 of the dishwasher 1 according to an embodiment of the present disclosure may control the power supply 48 so that during the washing cycle S2, there is a simultaneous operation period or a simultaneous operation process in which the power supply 48 supplies the power to the regeneration heater 831 and the washing water heater 47 at the same time.

Hereinafter, a case where the power is supplied to the regeneration heater 831 and the washing water heater 47 simultaneously during the cycle is referred to as the simultaneous operation process. A case where the power is supplied not simultaneously but non-simultaneously to each of the regeneration heater 831 and the washing water heater 47 is defined as the non-simultaneous operation process.

In one example, the controller 100 may be electrically connected to the blower motor of the blower 82 which constitutes the sorption drying device 80.

The controller 100 may generate the air flow F by supplying the power to the blower motor through the power supply 48 during the operation of the regeneration heater 831 for regenerating and drying the moisture absorbent 85 or during the drying cycle S5.

In one example, the controller 100 may be electrically connected to the memory and a timer. The controller 100 may retrieve an operation condition and a time condition related to each cycle that are pre-stored based on each washing course in the memory and may generate a control signal to control start and termination of the cycle according to the washing course, based on the retrieved operation condition and time condition.

Moreover, the controller 100 may calculate an elapsed time related to each cycle using the timer, and compare the elapsed time with a time condition related to each cycle pre-stored in the memory, and determine whether each cycle has been completed based on the comparing result.

Figure 15:
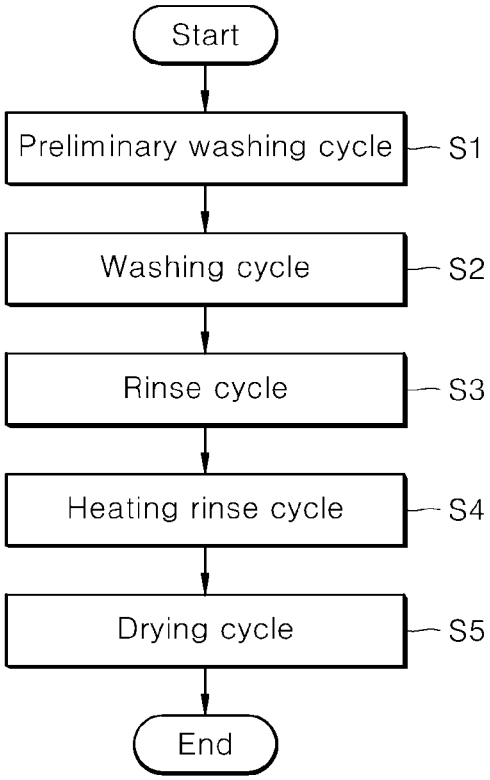
FIG. 15 is a flowchart of cycles in a dishwasher according to an embodiment of the present disclosure.

In this regard, the cycles may include the preliminary washing cycle S1, the washing cycle S2, the rinse cycle S3, the heating rinse cycle S4, and the drying cycle S5, as shown in FIG. 15.

Hereinafter, referring to FIG. 15 to FIG. 21B, a control method of the dishwasher 1 according to the present disclosure will be described.

As shown in FIG. 15, the controller 100 controls a cycle progress of the dishwasher 1 in which the preliminary washing cycle S1, the washing cycle S2, the rinse cycle S3, the heating rinse cycle S4, and the drying cycle S5 are performed in this order.

In the preliminary washing cycle S1, the dishwasher 1 circulates the washing water by operating the washing pump 45 without injecting the washing detergent through the washing detergent supply device and measures an amount of contamination through a turbidity sensor provided in the sump 41. In the washing cycle S2, the dishwasher 1 washes the dishes by circulating the washing water in a state in which the washing detergent has been injected thereto through the washing detergent supply device.

In the rinse cycle S3 and the heating rinse cycle S4, in a state in which the rinse has been injected from the washing detergent supply device, the washing water is circulated to remove the washing detergent remaining on the dish.

When performing the rinse cycle S3 and the heating rinse cycle S4, the dish may be heated to a predefined temperature by supplying the heated washing water thereto. Thus, the drying efficiency of the dish may be improved, and the drying time may be shortened in the drying cycle S5 which will be performed after the rinse cycle S3 and the heating rinse cycle S4 have been completed.

These detailed cycles may be omitted or combined with each other in an overlapping manner depending on the selected washing course settings and options.

In this regard, a water discharge cycle of the washing water used during each cycle and a water supply cycle of supplying new washing water may be included between the cycles.

The water supply cycle may be included before the preliminary washing cycle S1.

The water discharge cycle and the water supply cycle may occur between the preliminary washing cycle S1 and the washing cycle S2, between the washing cycle S2 and the rinse cycle S3, and between the heating rinse cycle S4 and the rinse cycle S3. The water discharge process may occur between the heating rinse cycle S4 and the drying cycle S5.

The water supply cycle may be performed by controlling an aqua stop provided in the water supply 43 to supply the washing water to the sump 41 through a water supply flow path. The water discharge cycle may be performed controlling the water discharger 44 connected to the sump 41 to drain the washing water out of the dishwasher 1 through a discharged water flow path.

Figure 16:
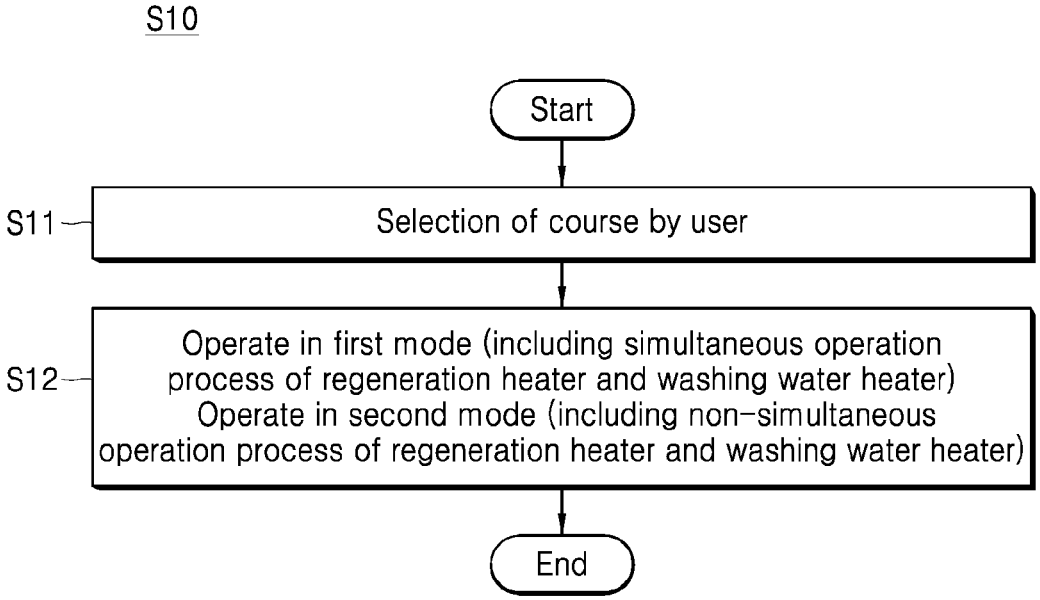
FIGS. 16 to 21B are flowcharts showing steps of a dishwasher control method according to an embodiment of the present disclosure.

FIG. 16 shows a control method S10 of the dishwasher 1 according to an embodiment of the present disclosure which will be performed during the preliminary washing cycle S1 or the heating rinse cycle S4.

Referring to FIG. 16, the control method S10 of the dishwasher 1 according to an embodiment of the present disclosure may include step S11 of receiving selection of the first washing course among the plurality of washing courses from the user, step S12 in which when the first washing course is selected based on the washing course selected in step S11, the first washing course is performed in the first mode including the non-simultaneous operation process in which the power is supplied non-simultaneously to each of the regeneration heater 831 and the washing water heater 47, or when the second washing course is selected, the second washing course is performed in the second mode which includes the simultaneous operation process in which the power is supplied simultaneously to the regeneration heater 831 and the washing water heater 47.

Figure 17:
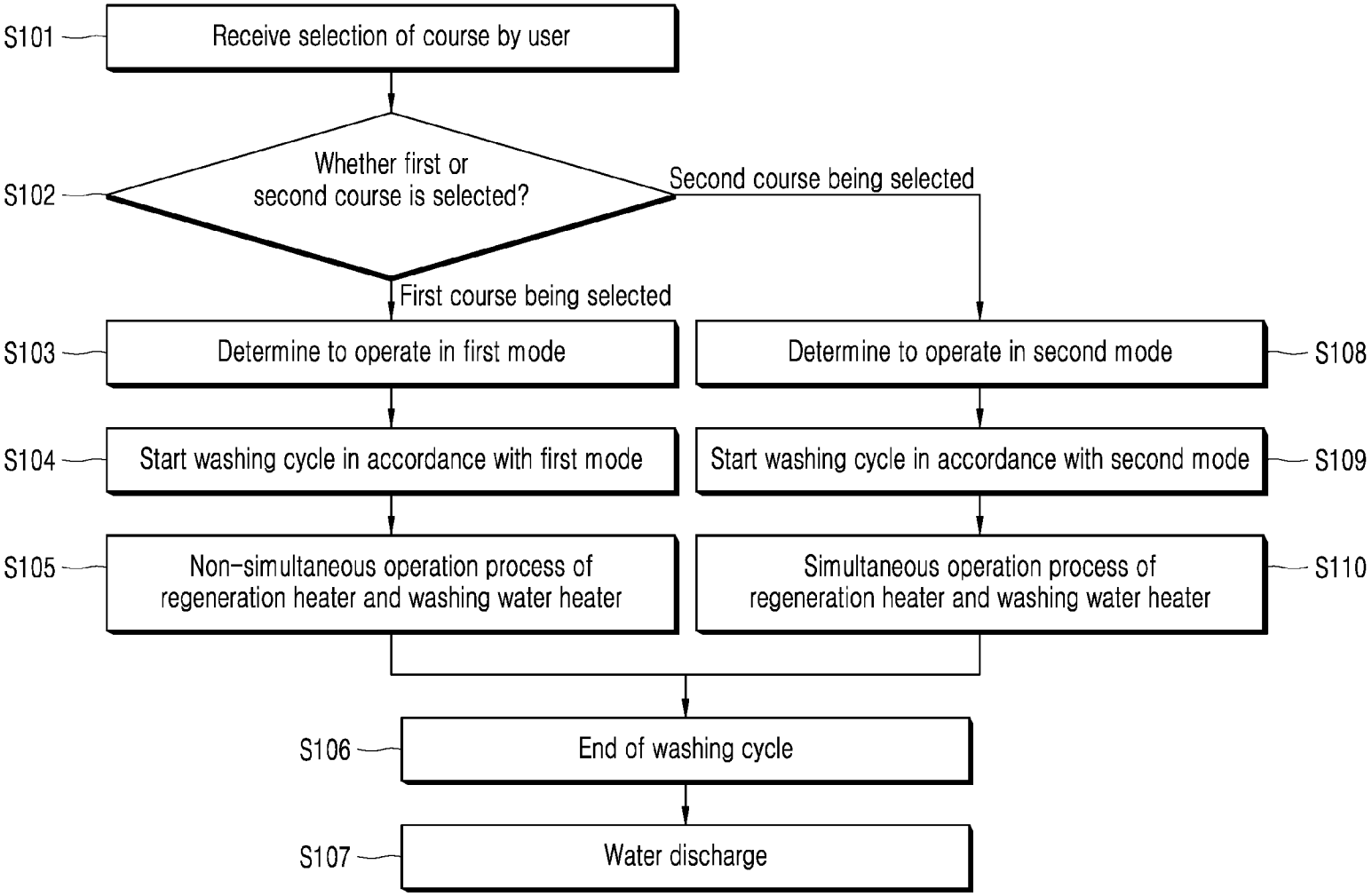
Figure 18:
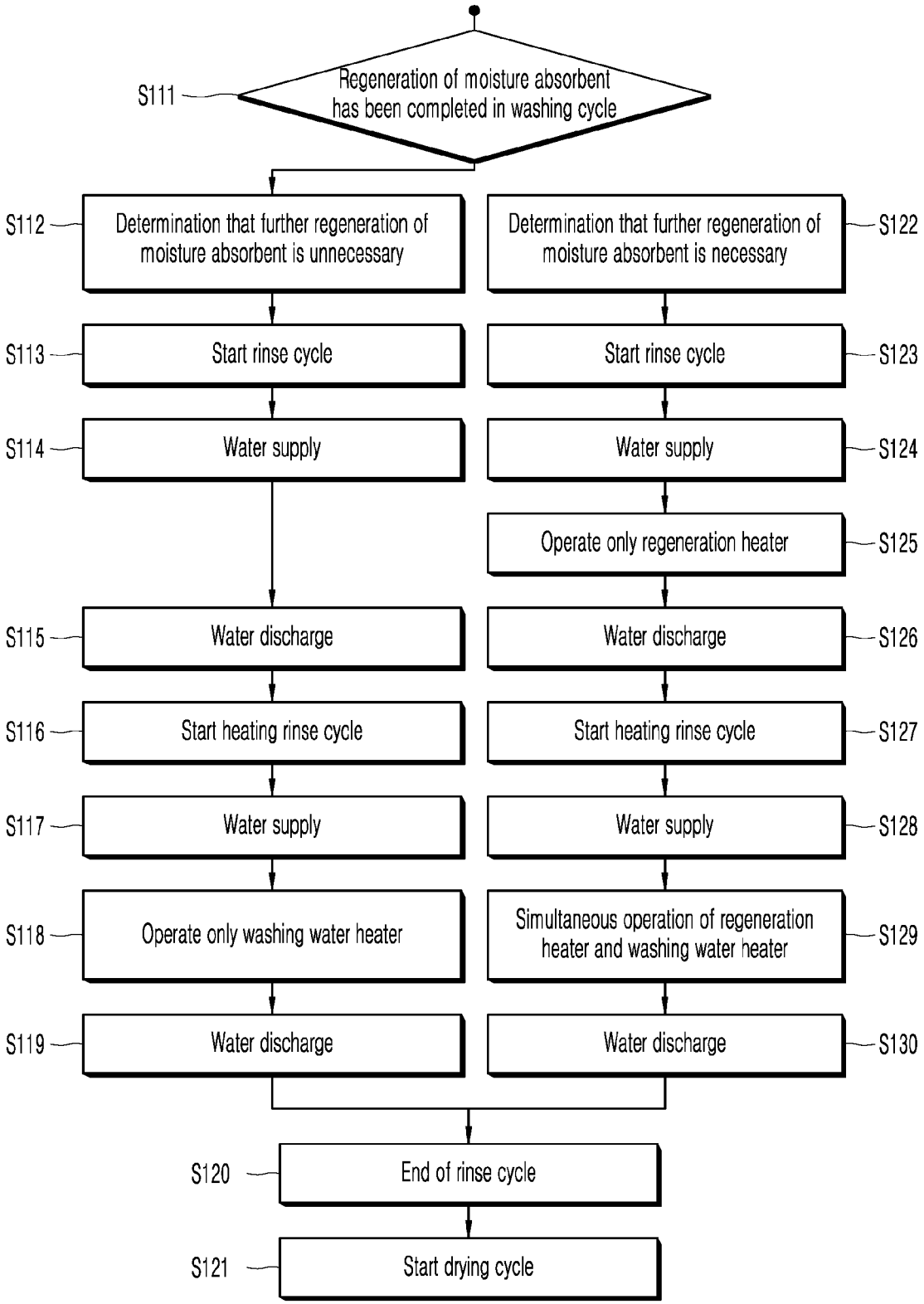

FIG. 17 and FIG. 18 show detailed steps of step S11 performed during the washing cycle S2 or during the rinse cycle S3/the heating rinse cycle S4.

First, referring to FIG. 17, the controller 100 may receive a manipulation signal of the washing course selection by the user through an input means such as the aforementioned button interface 34 or the user's wireless terminal in S101.

When the washing course selection manipulation has been received in step S101, the controller 100 determines whether the selected washing course is the first washing course or the second washing course in S102.

If it is determined that the washing course selected in step S102 is the first washing course, the controller 100 may determine to perform the detailed cycles according to the first mode, and may control the dishwasher to start the washing cycle according to the first mode in S103 and S104.

In other words, during the washing cycle S2, the controller 100 may control the power supply 48 so that the washing water heater 47 and the regeneration heater 831 do not turn on simultaneously so as to perform the non-simultaneous operation process in which the power is non-simultaneously supplied to each of the washing water heater 47 and the regeneration heater 831 according to the first mode in S105.

In one example, if it is determined that the washing course selected in step S102 is the second washing course, the controller 100 may determine to perform the detailed cycles according to the second mode, and may control the dishwasher to start the washing cycle according to the second mode in S108 and 109.

In other words, during the washing cycle S2, the controller 100 may control the power supply 48 so that the washing water heater 47 and the regeneration heater 831 turn on simultaneously so as to perform the simultaneous operation process in which the power is simultaneously supplied to the washing water heater 47 and the regeneration heater 831 according to the second mode in S110.

In this regard, as will be described later, the controller 100 may perform the simultaneous operation process in a manner of turning on the regeneration heater 831 and the washing water heater 47 at the same time, of turning on the regeneration heater 831 and the washing water heater 47 sequentially.

In one example, when the simultaneous operation process of the regeneration heater 831 and the washing water heater 47 has been completed, the controller 100 may perform remaining steps of the washing cycle S2 and then terminate the washing cycle S2 in S106.

After the washing cycle S2 has been completed, the water discharge cycle may be performed to discharge the washing water out of the dishwasher 1 in S107.

However, in the above-described step S105 or step S110, a situation may occur in which the power is supplied to the regeneration heater 831 such that the regeneration heater 831 operate simultaneously or non-simultaneously with the washing water heater 47, but an operation time of the regeneration heater 831 is not sufficient, so that the regenerating of the moisture absorbent 85 is incomplete. When the regenerating of the moisture absorbent 85 is incomplete, the controller 100 may maintain the power supply to the regeneration heater 831 such that the regenerating of the moisture absorbent 85 continues to be executed during the water discharge cycle that occurs after the washing cycle S2 has been completed.

Although the regeneration heater 831 has operated during the water discharge cycle after the washing cycle S2, the drying and the regenerating of the moisture absorbent 85 may not be completed.

For this reason, when the drying and regenerating of the moisture absorbent 85 is not completed during the washing cycle S2 and the water discharge cycle, the controller 100 may additionally operate the regeneration heater 831 to regenerate and dry the moisture absorbent 85 during the rinse cycle S3 and the heating rinse cycle S4 following the washing cycle S2 and the water discharge cycle.

More specifically, as shown in FIG. 18, the controller 100 may determine whether the drying and regenerating of the moisture absorbent 85 has been completed in the washing cycle S2 and the water discharge cycle as described above in S111.

In this regard, whether the drying and regenerating of the moisture absorbent 85 has been completed may be indirectly determined based on a time duration for which the power has been supplied to the regeneration heater 831 such that the regeneration heater 831 operates during the washing cycle S2 and the water discharge cycle. That is, the controller 100 may determine whether the drying and regenerating of the moisture absorbent 85 has been completed based on a comparing result between a preset regenerating time duration according to a capacity of the moisture absorbent 85 and an actual operation time duration of the regeneration heater 831.

If it is determined that the drying and regenerating of the moisture absorbent 85 has been completed in step S111, the controller 100 may determine that a further drying and regenerating process of the moisture absorbent 85 is unnecessary in S112.

In other words, the moisture absorbent 85 has been successfully dried. Thus, the controller 100 may determine that an additional operation of the regeneration heater 831 is unnecessary, and then may perform the rinse cycle S3 and the heating rinse cycle S4 according to the determined mode without the additional operation of the regeneration heater 831 in S113 to S121.

Therefore, the regeneration heater 831 is in a non-operating state. Thus, during the heating rinse cycle S4, the power is supplied only to the washing water heater 47 so that a non-simultaneous operation process in which the regeneration heater 831 does operate while the washing water heater 47 operates is performed in S118.

Otherwise, if it is determined in step S111 that the drying and regenerating process of the moisture absorbent 85 is incomplete or not successfully performed, the controller 100 may determine that the additional drying and regenerating process of the moisture absorbent 85 is necessary in S122.

Accordingly, the controller 100 may start the rinse cycle S3 in S123, and may control the power supply 48 so that the power is supplied only to the regeneration heater 831 through the power supply 48 to operate only the regeneration heater 831 during the rinse cycle S3 in S125.

In this regard, the power supply to the regeneration heater 831 may continue in the water supply cycle and the water discharge cycle in S124 and S126 which are performed after the rinse cycle S3 has been completed and before the start of the heating rinse cycle S4.

Thereafter, when the water supply cycle and the water discharge cycle S121 have been completed, and the heating rinse cycle S4 is started in S127, the controller 100 may control the power supply 48 to supply the power to the washing water heater 47 to operate both the regeneration heater 831 and the washing water heater 47 in a simultaneous operation manner in S129.

In one example, when the water discharge cycle 130 is started after the heating rinse cycle S4 has been completed, the controller 100 may control the power supply 48 such that the power supply to the washing water heater 47 is stopped, while the power supply to the regeneration heater 831 is maintained for drying and regenerating the moisture absorbent 85. In this case, the dishwasher may perform the non-simultaneous operation process in which the power is supplied not to the washing water heater 47 but only to the regeneration heater 831.

In one example, when the simultaneous operation process or the non-simultaneous operation process of the regeneration heater 831 and the washing water heater 47 has been completed, the controller 100 may perform remaining steps of the heating rinse cycle S4, and may terminate the heating rinse cycle S4 and may start the drying cycle S5 in S121.

FIGS. 19 to 21B show a detailed configuration of steps S107, S117, and S123 of operating the regeneration heater 831 and the washing water heater 47 in the simultaneous operation process during the aforementioned washing cycle S2 or the aforementioned heating rinse cycle S4.

Figure 19:
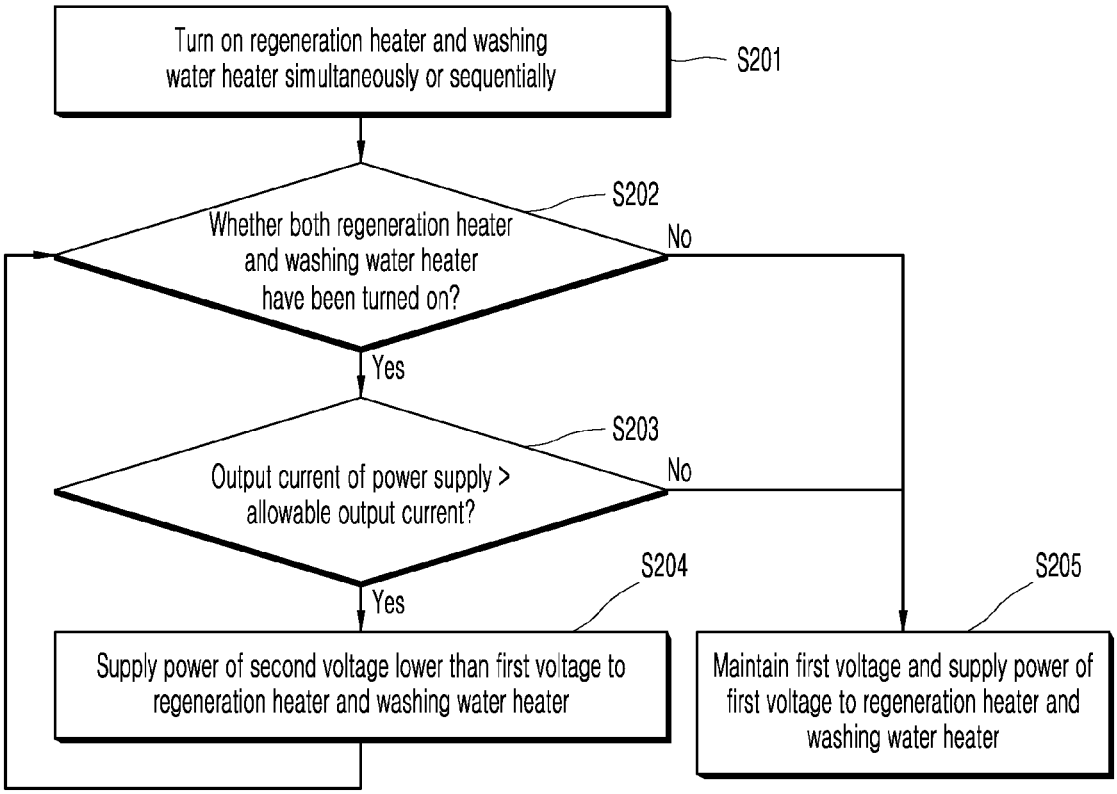

First, referring to FIG. 19, in order to perform steps S110 and S129 of operating the regeneration heater 831 and the washing water heater 47 in the simultaneous operation process, the controller 100 may control the power supply 48 to supply the power both to the regeneration heater 831 and the washing water heater 47 and thus may turn on the regeneration heater 831 and the washing water heater 47 simultaneously or sequentially in S201.

After step S201, the controller 100 may determine whether the power has been supplied to both the regeneration heater 831 and the washing water heater 47 through the power supply 48 and thus, both have been turned on in S202.

If it is determined that both the regeneration heater 831 and the washing water heater 47 are turned on in step S202, the controller 100 determines whether an output current of the power supply 48 that supplies the power to the regeneration heater and the washing water heater 47 exceeds a preset allowable output current in S203.

Information on the preset allowable output current may be stored in the aforementioned memory. The controller 100 may retrieve the information about the allowable output current from the memory and compare a current output current of the power supply 48 with the retrieved information and may determine whether an overload occurs in the power supply 48 based on the comparing result.

If it is determined in step S203 that the output current of the power supply 48 exceeds the preset allowable output current, the controller 100 may adjust the output of the power supply 48 so that the power with the second voltage lower than the first voltage of the initial power is supplied to the washing water heater 47 and the regeneration heater 831, and may supply the power having the adjusted output to the washing water heater 47 and/or the regeneration heater 831 in S204.

For example, the power supply 48 may be provided in a form of a variable transformer whose output voltage may be adjusted. For example, as known to those in the art, the output of the variable transformer may be adjusted by varying resistance or inductance of the primary or secondary coil thereof.

As described above, each of the washing water heater 47 and the regeneration heater 831 provided in the dishwasher 1 according to an embodiment of the present disclosure may be embodied as a variable capacity heater whose output varies depending on an intensity of the power supplied thereto from power supply 48. For example, each of the washing water heater 47 and the regeneration heater 831 may be embodied as a heating element whose output may vary depending on the intensity of the power supplied thereto. In particular, the washing water heater 47 may be embodied as a sheath heater, a carbon heater, or a ceramic heater.

Therefore, if it is determined in step S203 that the regeneration heater 831 and the washing water heater 47 operate simultaneously and thus an overload will occur in the power supply 48, the controller 100 may supply the power of the second voltage lower than the first voltage to either or both the washing water heater 47 and the regeneration heater 831 so that a lower output is generated through cither or both the washing water heater 47 and the regeneration heater 831. Thus, the output capacity of at least one of the washing water heater 47 and the regeneration heater 831 may be adjusted.

For example, the second voltage in the range of 90V to 100V which is lower than the first voltage in the range of 110V to 130V may be supplied to the washing water heater 47 with a rated capacity in the range of 100 W to 1300 W. Thus, the output capacity of the washing water heater 47 may be adjusted to be in a range from 700 W to 900 W.

Thus, the output current of the power supply 48 may be maintained at a value below the acceptable output current, and thus the overloading of the power supply 48 may be effectively prevented.

However, if it is determined that both the regeneration heater 831 and the washing water heater 47 are not turned on in step S202, or if it is determined that the output current of the power supply 48 does not exceed the preset allowable output current in step S203, the controller 100 may determine that no overload has occurred in the power supply 48 and thus may continue to maintain the supply of the first voltage to the regeneration heater 831 and the washing water heater 47 without adjusting the initial power supplied to the regeneration heater 831 and the washing water heater 47 in S205.

Unlike a configuration as shown in FIG. 19, as soon as it is determined that both the regeneration heater 831 and the washing water heater 47 are turned on in step S202, the controller 100 may adjust the output of the power supply 48 to supply the power with the second voltage lower than the first voltage of the initial power supplied to the washing water heater 47 and the regeneration heater 831 thereto.

That is, in response to that, regardless of whether the overload occurs in the power supply 48, both the regeneration heater 831 and the washing water heater 47 are identified as being turned on, the controller 100 may be configured to supply the second voltage lower than the first voltage to either or both of the washing water heater 47 and the regeneration heater 831 so that the lower output is generated through either or both of the washing water heater 47 and the regeneration heater 831. In this way, the output capacity of either or both of the washing water heater 47 and the regeneration heater 831 may be adjusted. Thus, the overload of the power supply 48 due to the simultaneous turned-on state of the washing water heater 47 and the regeneration heater 831 may be prevented in a in a proactive manner.

FIGS. 20A through FIG. 21B show a detailed configuration of step S201 of supplying the power to the regeneration heater 831 and the washing water heater 47 through the power supply 48 to turn both on simultaneously or sequentially.

Figure 20A:
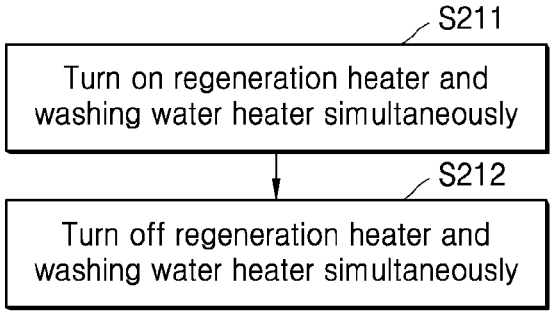

First, as shown in FIG. 20A, the controller 100 may simultaneously turn on the regeneration heater 831 and the washing water heater 47 by simultaneously supplying the power thereto through the power supply 48 in S211.

When the regeneration heater 831 and the washing water heater 47 are turned on at the same time in step S211, the controller 100 may maintain the turned-on state thereof until a predefined time has elapsed, and then may simultaneously turn off the power supplied to the regeneration heater 831 and the washing water heater 47 by simultaneously cutting off the power supplied to the regeneration heater 831 and the washing water heater 47 in S212.

Figure 20B:
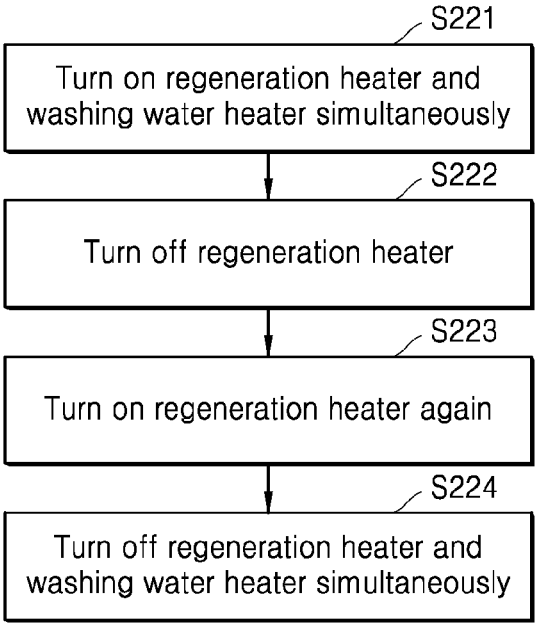

Alternatively, as shown in FIG. 20B, the controller 100 may perform, between step S221 of simultaneously turning on the regeneration heater 831 and the washing water heater 47 and step S224 of simultaneously turning off the regeneration heater 831 and the washing water heater 47, step S222 of turning off the regeneration heater 831 by cutting off the power supplied to the regeneration heater 831, and step S223 of re-supplying the power to the regeneration heater 831 to turn the regeneration heater 831 back on.

In other words, while the turned-on state of the washing water heater 47 is maintained, the regeneration heater 831 may be repeatedly turned-on and turned-off, and turned-on and turned-off, so that an overlapping period for which the regeneration heater 831 and the washing water heater 47 are simultaneously turned on may be repeated.

This configuration may be applied to a case where the operation time of the washing cycle S2 or the operation time of the heating rinse cycle S4 may be maintained to be larger than the operation time of the regeneration heater 831, but a difference therebetween is not large.

Therefore, this configuration may be suitable for a case where the overlapping period between the operation time during which the turned-on state of the regeneration heater 831 is maintained and the operation time during which the turned-on state of the washing water heater 47 is maintained should be maintained be relatively large.

Figure 21A:
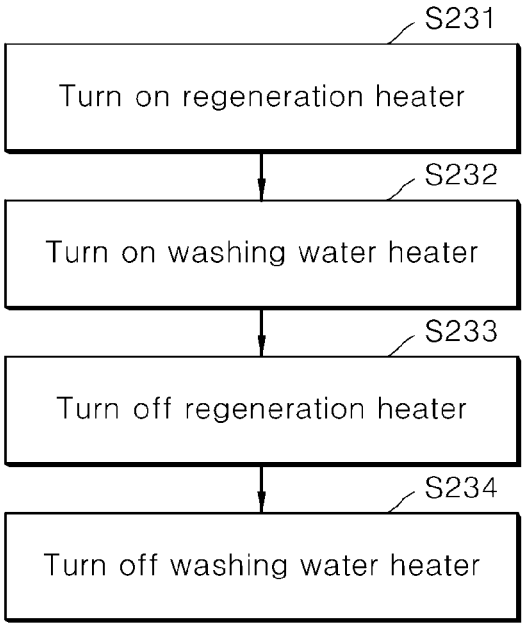

In one example, as shown in FIG. 21A, the controller 100 may first turn on the regeneration heater 831 by first supplying the power to the regeneration heater 831 through the power supply 48 in S231.

After the regeneration heater 831 has been first turned on in step S231, the controller 100 may turn on the washing water heater 47 by supplying the power to the washing water heater 47 through the power supply 48 in S232.

After the washing water heater 47 has been turned on in step S232, the controller 100 may first turn off the regeneration heater 831 by cutting off the power supplied to the regeneration heater 831 in S233.

After the regeneration heater 831 has been turned off in step S233, the controller 100 may turn off the washing water heater 47 by cutting off the power supplied to the washing water heater 47 in S234.

Figure 21B:
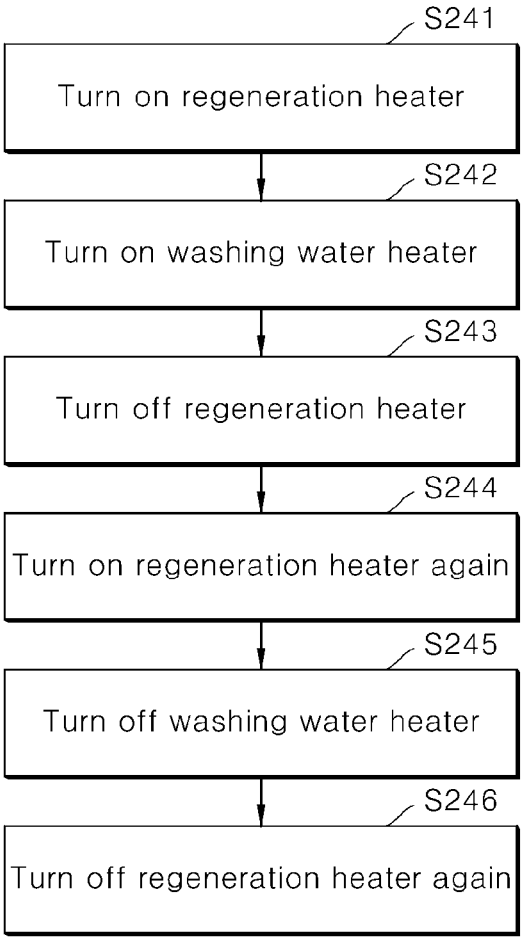

Alternatively, as shown in FIG. 21B, after step S241 of turning on the regeneration heater 831, step S243 of turning on the washing water heater 47, and step S242 of turning off the regeneration heater 831, and before step 245 of turning off the washing water heater 47, the controller 100 may turn on the regeneration heater 831 again by re-supplying the power to the regeneration heater 831 in S244.

After the washing water heater has been turned off in step S245, the controller 100 may turn off the regeneration heater 831 again by cutting off the power supplied to the regeneration heater 831 in S246.

In other words, while the turned-on state of the washing water heater 47 is maintained, the regeneration heater 831 may be controlled to be repeatedly turned-on and turned-off and turned-on and turned-off, so that the overlapping period for which the regeneration heater 831 and the washing water heater 47 are simultaneously turned on may be repeated.

This configuration may be applied to a case where the operation time of the washing cycle S2 or the operation time of the heating rinse cycle S4 may be maintained longer than the operation time of the regeneration heater 831, and a difference therebetween may be relatively large.

Therefore, this configuration may be suitable for a case wherein the overlapping period between the operation time for which the turned-on state of the regeneration heater 831 is maintained and the operation time for which the turned-on state of the washing water heater 47 is maintained may be kept relatively short.

Although the embodiments of the present disclosure have been described in more detail with reference to the accompanying drawings, the present disclosure is not necessarily limited to these embodiments, and may be modified in a various manner within the scope of the technical spirit of the present disclosure. Accordingly, the embodiments as disclosed in the present disclosure are intended to describe rather than limit the technical idea of the present disclosure, and the scope of the technical idea of the present disclosure is not limited by these embodiments. Therefore, it should be understood that the embodiments described above are not restrictive but illustrative in all respects. In addition, even though an effect of a configuration of the present disclosure is not explicitly described in describing the embodiment of the present disclosure above, it is obvious that the predictable effect from the configuration should be recognized.

What is claimed is:

1. A dishwasher comprising:

a tub that defines a washing space configured to accommodate one or more objects to be washed; and a sorption drying device comprising:

a moisture absorbent configured to absorb water vapor in air discharged from the tub, and a regeneration heater configured to heat the air to be supplied to the moisture absorbent to thereby dry the moisture absorbent;

a washing water heater configured to heat washing water to be supplied to the washing space; and a controller configured to perform a plurality of courses, each of the plurality of courses comprising a plurality of cycles for washing the one or more objects, wherein the plurality of courses include a first course and a second course, and wherein the controller is configured to, based on the second course being selected, perform a simultaneous operation process in which power is supplied to both of the regeneration heater and the washing water heater.

2. The dishwasher of claim 1, wherein the controller is configured to, based on the first course being selected, perform a non-simultaneous operation process in which power is supplied to one of the regeneration heater or the washing water heater.

3. The dishwasher of claim 2, wherein an operating time of the second course is less than an operating time of the first course.

4. The dishwasher of claim 1, wherein an operating time of the second course is less than or equal to one hour.

5. The dishwasher of claim 1, wherein the plurality of cycles of the second course comprise a washing cycle, and wherein the controller is further configured to, based on the second course being selected, perform the washing cycle by supplying the power to the regeneration heater and the washing water heater while the washing cycle is performed.

6. The dishwasher of claim 5, wherein the controller is further configured to maintain the power to be supplied to the regeneration heater during a water discharge cycle, wherein the water discharge cycle is configured to be executed after each of the plurality of courses has been completed.

7. The dishwasher of claim 1, wherein the plurality of cycles of the second course comprise a rinse cycle, and wherein the controller is further configured to, based on the second course being selected, perform the rinse cycle by supplying the power to the regeneration heater while the rinse cycle is performed.

8. The dishwasher of claim 7, wherein the controller is further configured to maintain the power to be supplied to the regeneration heater during a water discharge cycle and a water supply cycle, wherein the water discharge cycle and the water supply cycle are configured to be executed after the rinse cycle has been completed.

9. The dishwasher of claim 1, wherein the plurality of cycles of the second course comprise a heating rinse cycle, and wherein the controller is configured to, based on the second course being selected, perform the heating rinse cycle by simultaneously supplying the power to the regeneration heater and the washing water heater while the heating rinse cycle is performed.

10. The dishwasher of claim 9, wherein the controller is further configured to maintain the power to be supplied to the regeneration heater during a water discharge cycle, wherein the water discharge cycle is configured to be executed after the heating rinse cycle has been completed.

11. The dishwasher of claim 1, wherein the simultaneous operation process comprises:

supplying the power to the regeneration heater and the washing water heater to thereby turn on the regeneration heater and the washing water heater simultaneously, or supplying the power to the regeneration heater and the washing water heater to thereby turn on the regeneration heater and the washing water heater sequentially.

12. The dishwasher of claim 11, wherein the simultaneous operation process further comprises:

after the regeneration heater and the washing water heater have been turned on simultaneously or sequentially, turning off both the regeneration heater and the washing water heater by simultaneously cutting off the power supplied to the regeneration heater and the washing water heater.

13. The dishwasher of claim 12, wherein the simultaneous operation process further comprises:

before simultaneously turning off the regeneration heater and the washing water heater, (i) turning off the regeneration heater by cutting off the power supplied to the regeneration heater, and (ii) turning the regeneration heater back on by re-supplying the power to the regeneration heater after the regeneration heater has been turned off.

14. The dishwasher of claim 12, wherein the simultaneous operation process further comprises:

after the regeneration heater and the washing water heater have been turned on simultaneously or sequentially, sequentially turning off the regeneration heater and the washing water heater by sequentially cutting off the power supplied to the regeneration heater and the washing water heater.

15. The dishwasher of claim 11, wherein the controller is further configured to:

after supplying the power to the regeneration heater and the washing water heater to thereby turn on the regeneration heater and the washing water heater simultaneously or sequentially, adjust a voltage of the power supplied to the regeneration heater and the washing water heater to thereby limit an output current of a power supply below a preset allowable output current, the power supply being configured to supply the power to the regeneration heater and the washing water heater.

16. The dishwasher of claim 15, wherein the controller is further configured to:

control the power supply to supply the power of a first voltage to the regeneration heater or the washing water heater based on one of the regeneration heater or the washing water heater being turned on; and control the power supply to supply the power of a second voltage less than or equal to the first voltage to the regeneration heater or the washing water heater based on both of the regeneration heater and the washing water heater being turned on.

17. The dishwasher of claim 16, wherein the washing water heater comprises a variable capacity heater configured to:

based on the first voltage being supplied to the variable capacity heater, generate an output of 1100 W to 1300 W; and based on the second voltage being supplied to the variable capacity heater, generate an output of 700 W to 900 W.

18. The dishwasher of claim 17, wherein the variable capacity heater comprises at least one of a sheath heater, a carbon heater, or a ceramic heater.

19. The dishwasher of claim 16, wherein the power supply comprises a variable transformer configured to adjust an output voltage thereof to thereby enable the power supply to provide (i) the first voltage in a range from 110V to 130V and (ii) the second voltage in a range from 90V to 100V.

20. The dishwasher of claim 1, wherein the sorption drying device further comprises a discharge guide configured to supply the air passing through the moisture absorbent to the washing space.

* * * * *